US006933910B2

(12) United States Patent
Kodate et al.

(10) Patent No.: US 6,933,910 B2
(45) Date of Patent: Aug. 23, 2005

(54) IMAGE DISPLAY DEVICE AND METHOD THEREOF

(75) Inventors: Manabu Kodate, Yokohama (JP); Kai Schleupen, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 348 days.

(21) Appl. No.: 09/683,166

(22) Filed: Nov. 28, 2001

(65) Prior Publication Data

US 2002/0070905 A1 Jun. 13, 2002

(30) Foreign Application Priority Data

Dec. 7, 2000 (JP) ..... 2000-373599

(51) Int. Cl.[7] ..... G09G 3/20

(52) U.S. Cl. ..... 345/55; 345/50; 345/87; 345/90; 345/92; 345/204

(58) Field of Search ..... 345/55, 50, 87, 345/90, 92, 204–206, 214, 79, 80, 38, 48, 58, 84, 100, 696, 698; 349/42–43, 48

(56) References Cited

U.S. PATENT DOCUMENTS 5,579,140 A * 11/1996 Yamahara et al. ..... 349/124
6,023,308 A * 2/2000 Takemura ..... 349/42
6,028,577 A * 2/2000 Sakamoto ..... 345/92
6,323,871 B1 * 11/2001 Fujiyoshi et al. ..... 345/598
6,476,787 B1 * 11/2002 Libsch et al. ..... 345/92
6,486,930 B1 * 11/2002 Kwon ..... 349/48
6,501,453 B1 * 12/2002 Wong ..... 345/90
6,512,504 B1 * 1/2003 Yamauchi et al. ..... 345/87
6,583,777 B2 * 6/2003 Hebiguchi et al. ..... 345/92
6,727,875 B1 * 4/2004 Mikami et al. ..... 345/92

FOREIGN PATENT DOCUMENTS

| | | | |
|---|---|---|---|
| JP | 05-188395 | 7/1993 | G02F/1/136 |
| JP | 05-265045 | 10/1993 | G02F/1/136 |
| JP | 05-303114 | 11/1993 | G02F/1/136 |
| JP | 05-341734 | 12/1993 | G09G/3/36 |
| JP | 06-138851 | 5/1994 | G09G/3/36 |
| JP | 06-148680 | 5/1994 | G02F/1/136 |
| JP | 11-002837 | 1/1999 | G02F/1/136 |

* cited by examiner

*Primary Examiner*—Vijay Shankar
*Assistant Examiner*—Leonid Shapiro
(74) *Attorney, Agent, or Firm*—McGinn & Gibb, PLLC; Derek S. Jennings, Esq.

(57) ABSTRACT

A liquid crystal display includes a first TFT for controlling a supply of a display signal to a pixel electrode, a second TFT connected to the first TFT, and a third TFT connected to a data line. The third TFT controls the supply of a display signal to the pixel electrode. The second and third TFTs are connected to a gate line Gn+1, and the first TFT is connected to a gate line Gn+2.

25 Claims, 27 Drawing Sheets

IMAGE DISPLAY DEVICE AND METHOD THEREOF

BACKGROUND OF INVENTION

The present invention relates to a technology that contributes to the achievement of high definition of an image display apparatus, particularly a liquid crystal display apparatus.

A high resolution of a display that showed a slow progress in a CRT display has been achieved with an introduction of a new technology including a liquid crystal. Namely, high-definition imaging in a liquid crystal display apparatus can be achieved relatively easily by microprocessing, compared to that in a CRT display.

As the liquid crystal display apparatus, an active matrix type liquid crystal display apparatus using a thin film transistor (hereinafter referred to as a TFT) as a switching element has been known. The active matrix type liquid crystal display apparatus has a structure that scanning lines and signal lines are arrayed on a TFT array substrate in a matrix fashion, a TFT is arranged in each intersection point of the scanning lines and the signal lines on the TFT array substrate, and a liquid crystal material is sealed between the TFT array substrate and an opposite substrate disposed with a predetermined space therebetween. The liquid crystal display apparatus controls a voltage applied to the liquid crystal material by the use of the TFT, thus making it possible to display an image by utilizing an electro-optic effect of liquid crystal.

FIG. 27 shows an equivalent circuit diagram of the TFT array substrate. As shown in FIG. 27, the signal lines 30 and the scanning lines 40 are arrayed in a matrix fashion, and an area surrounded by each signal line 30 and each scanning line 40 forms a unit pixel. The unit pixel comprises a pixel electrode 20 and a TFT 10 connected thereto.

The following problems are posed as the number of the pixels increases with an advanced definition of the active matrix type liquid crystal display apparatus. Specifically, with the increase in the number of the pixels, the number of the signal lines and the scanning lines becomes larger, and the number of driver ICs becomes vast, resulting in an increase of cost. Furthermore, an electrode pitch between signal lines on an array substrate for connecting a driver IC thereto becomes small, so that a connection of the driver IC to the signal line is difficult and a yield of a connection operation is lowered.

To solve such a problem, many proposals have been made in which the number of the driver ICs required is reduced and a pitch of connection terminals is made large by time-divisionally applying a potential from one signal line to two pixels which are adjacent to each other. For example, these proposals are disclosed in Japanese Patent Laid-Open Gazettes No. 138851/1994, No. 148680/1994, No. 2837/1999, No. 265045/1993, No. 188395/1993 and No. 303114/1993.

Among these gazettes, in Japanese Patent Laid-Open Gazette No. 138851/1 994, disclosed is a structure in which a multiplexer circuit is provided outside a pixel matrix, and a potential is supplied from one data driver output to a plurality of signal lines.

In Japanese Patent Laid-Open Gazette No. 148680/1994, the following proposal is made. Specifically, in a matrix panel composed of pixels in N rows and M columns, drain electrodes of t TFTs (t: any integer) adjacent to each other for each row and each column are connected together to be formed by one signal line, and t signal lines are formed for each row so that each of the TFTs connected collectively can be controlled independently.

In Japanese Patent Laid-Open Gazette No. 2837/1999, the following proposal is made. Specifically, two scanning lines are provided so as to be allocated to one row of pixels, and one signal line is provided so as to be allocated to two columns of pixels. A common line connected to a common electrode is provided. A pixel array is arranged, which has a first group of pixels driven via a TFT selected by one of the two scanning lines and a second group of pixels driven via a TFT selected by the other scanning line, and the first and second groups of pixels share a part of the common electrode.

However, according to the proposal of Japanese Patent Laid-Open Gazette No. 138851/1994, there is a problem that since TFTs used for the multiplexer circuit allow respective liquid crystal capacitors of the signal lines to store charges therein within a predetermined time as short as several microseconds to several tens of microseconds, the multiplexer circuit becomes enormous, resulting in a decrease in a manufacturing yield. According to the proposals of Japanese Patent Laid-Open gazettes No. 148680/1994 and No. 2837/1999, there is a problem that though the enormous multiplxer circuit is unnecessary, the number of the gate driver outputs and the number of the scanning lines are doubled.

Contrary to these proposals, the proposals disclosed in Japanese Patent Laid-Open Gazette No. 265045/1993, No. 188395/1993 and No. 303114/1993 do not have the above-described problems. One of the proposals disclosed in Japanese Patent Laid-Open Gazette No. 265045/1993 is shown in FIG. 28. A structure that two pixels are connected to one signal line via TFTs P1 to P3 is disclosed. Accordingly, since the number of the signal lines may be a half of the conventional one, the number of the outputs of the data driver can be made to be a half of the conventional one. However, information notifying that this technology has been put to practical use is not obtained until now.

SUMMARY OF INVENTION

Accordingly, the subject of the present invention is to provide an image display device capable of reducing the number of signal lines by half of the conventional one without presence of an enormous multiplexer or without increasing the number of scanning lines.

An image display device of a first aspect of the present invention comprises: a plurality of signal lines for supplying a display signal; a plurality of scanning lines for supplying a scanning signal; first and second pixel electrodes supplied with the display signal from a predetermined signal line; a first switching element arranged between the predetermined signal line and the first pixel electrode, the first switching element having a gate electrode for controlling supply of the display signal; a second switching element arranged between the gate electrode of the first switching element and a predetermined scanning line; and a third switching element connected to the predetermined signal line, the third switching element being for controlling supply of the display signal to the second pixel electrode.

An image display device of a second aspect of the present invention comprises: a signal line for supplying a display signal; first and second pixel electrodes arranged so as to interpose the signal line therebetween; a first switching element connected to the signal line, the first switching element being for controlling supply of the display signal to the first pixel electrode; a second switching element connected to the first switching element; a third switching element connected to the signal line, the third switching element being for controlling supply of the display signals to the second pixel electrode; a first scanning line for supplying a scanning signal to the second and third switching elements; and a second scanning line for supplying a scanning signal to the first switching element.

An image display device of a third aspect of the present invention, in which a plurality of signal lines for supplying display signals and a plurality of scanning lines for supplying scanning signals are arrayed in a matrix fashion, comprises: first and second pixel electrodes arranged between a n-th scanning line and a (n+1)-th scanning line (n: positive integer), the first and second pixel electrodes being supplied with a display signal from a specified signal line; a first switching mechanism for permitting the display signal to pass to the first pixel electrode when the (n+1)-th scanning line and a (n+m)-th scanning line (m: integer excluding 0 and 1) are simultaneously being selected; and a second switching mechanism for permitting the display signal to pass to the second pixel electrode when the (n+1)-th scanning line is being selected.

An image display device of a fourth aspect of the present invention comprises: a plurality of signal lines for supplying display signals; a plurality of scanning lines for supplying scanning signals; a first pixel electrode arranged between a n-th scanning line (n: positive integer) and a (n+1)-th scanning line, the first pixel electrode being connected to a specified signal line; and a second pixel electrode connected to the specified signal line, wherein the first pixel electrode is driven by a first scanning signal from the (n+1)-th scanning line and a second scanning signal from a (n+m)-th scanning line (m: integer excluding 0 and 1), and the second pixel electrode is driven by a scanning signal from the (n+1)-th scanning line.

The present invention provides the following image display apparatuses using the image display device of the present invention. An image display apparatus of the present invention, which arrays pixels in a matrix fashion composed of M rows and N columns (M and N: arbitrary positive integer) to form an image display section, comprises: a signal line driving circuit for supplying display signals; a scanning line driving circuit for supplying scanning signals; a plurality of signal lines extending from the signal line driving circuit; a plurality of scanning lines extending from the scanning line driving circuit; first and second pixel electrodes arranged between a n-th scanning line (n: positive integer equal to N or less) and a (n+1)-th scanning line so as to be adjacent to each other with a specified signal line interposed therebetween; a first switching element driven by a scanning signal from a (n+2)-th scanning line, the first switching element being for controlling supply of a display signal from the specified signal line to the first pixel electrode; a second switching element driven by a scanning signal from the (n+1)-th scanning line, the second switching element being for controlling turning ON/OFF of the first switching element; and a third switching element driven by a scanning signal from the (n+1)-th scanning line, the third switching element being for controlling supply of a display signal from the specified signal line to the second pixel electrode.

An image display apparatus of the present invention, which arrays pixels in a matrix fashion composed of M rows and N columns (M and N: arbitrary positive integer) to form an image display section, comprises: a signal line driving circuit for supplying display signals; a scanning line driving circuit for supplying scanning signals; a plurality of signal lines extending from the signal line driving circuit; a plurality of scanning lines extending from the scanning line driving circuit; first and second pixel electrodes arranged between a n-th scanning line (n: positive integer equal to N or less) and a (n+1)-th scanning line so as to be adjacent to each other with a specified signal line interposed therebetween; a first switching element driven by a scanning signal from the (n+1)-th scanning line, the first switching element being for controlling supply of a display signal from the specified signal line to the first pixel electrode; a second switching element driven by a scanning signal from a (n+2)-th scanning line, the second switching element being arranged between the first switching element and the first pixel electrode; and a third switching element driven by the scanning signal from the (n+1)-th scanning line, the third switching element being for controlling supply of the display signal from the specified signal line to the second pixel electrode.

The present invention was described on condition that the two pixel electrodes share one signal line. However, the present invention is not limited to the case where the two pixel electrodes share one signal line. The scope of the present invention should be construed as that at least two pixel electrodes share one signal line, and the present invention can be also constituted such that three or more pixel electrodes can shared by one signal line.

Specifically, the present invention provides an image display apparatus, which arrays pixels in a matrix fashion composed of M rows and N columns (M and N: arbitrary positive integer) to form an image display section, comprises: a signal line driving circuit for supplying display signals; a scanning line driving circuit for supplying scanning signals; a plurality of signal lines extending from the signal line driving circuit; a plurality of scanning lines extending from the scanning line driving circuit; first, second and third pixel electrodes arranged between a n-th scanning line (n: positive integer equal to N or less) and a (n+1)-th scanning line, the first, second and third pixel electrodes being supplied with a display signal from a specified signal line; a first switching element driven by a scanning signal from a (n+3)-th scanning line, the first switching element being for controlling supply of the display signal from the specified signal line to the first pixel electrode; a second switching element driven by a scanning signal from the (n+1)-th scanning line, the second switching element being for controlling turning ON/OFF of the first switching element; a third switching element driven by the scanning signal from the (n+1)-th scanning line, the third switching element being for controlling supply of the display signal from the specified signal line to the second pixel electrode; a fourth switching element driven by a scanning signal from a (n+2)-th scanning line, the fourth switching element being for controlling supply of the display signal from the specified signal line to the third pixel electrode; and a fifth switching element driven by the scanning signal from the (n+1)-th scanning line, the fifth switching element being for controlling turning ON/OFF of the fourth switching element.

The image display apparatus of the present invention described above is characterized in that each of the pixel electrodes is driven by the scanning signal supplied from each of the different scanning lines. Accordingly, the present invention provides an image display apparatus, which arrays pixels in a matrix fashion composed of M rows and N columns (M and N: arbitrary positive integer) to form an image display section, comprises: a signal line driving circuit for supplying display signals; a scanning line driving circuit for supplying scanning signals; a plurality of signal lines extending from the signal line driving circuit; a plurality of scanning lines extending from the scanning line driving circuit; and first, second and third pixel electrodes arranged on the same display line, the first, second and third pixel electrodes being supplied with display signals from a specified signal line, wherein the first, second and third pixel electrodes are driven by scanning signals from the different scanning lines.

Furthermore, the present invention provides an image display apparatus, which arrays pixels in a matrix fashion composed of M rows and N columns (M and N: arbitrary positive integer) to form an image display section, comprises: a signal line driving circuit for supplying display signals; a scanning line driving circuit for supplying scanning signals; a plurality of signal lines extending from the signal line driving circuit; a plurality of scanning lines extending from the scanning line driving circuit; first and second pixel electrodes arranged between a n-th scanning line (n: positive integer equal to N or less) and a (n+1)-th scanning line so as to be adjacent to each other with a specified signal line interposed therebetween; a first switching element driven by a scanning signal from the (n+1)-th scanning line, the first switching element being for controlling supply of a display signal from the specified signal line to the first pixel electrode; a second switching element driven by a scanning signal from the n-th scanning line, the second switching element being for controlling turning ON/OFF of the first switching element; and a third switching element driven by a scanning signal from the n-th scanning line, the third switching element being for controlling supply of the display signal from the specified signal line to the second pixel electrode.

Furthermore, the present invention provides an image display apparatus, which arrays pixels in a matrix fashion composed of M rows and N columns (M and N: arbitrary positive integer) to form an image display section, comprises: a signal line driving circuit for supplying a display signal; a scanning line driving circuit for supplying a scanning signal; a plurality of signal lines extending from the signal line driving circuit; a plurality of scanning lines extending from the scanning line driving circuit; first and second pixel electrodes arranged between a n-th scanning line (n: positive integer equal to N or less) and a (n+1)-th scanning line so as to be adjacent to each other with a specified signal line interposed therebetween; a first switching element driven by a scanning signal from the (n+2)-th scanning line, the first switching element being for controlling supply of a display signal from the specified signal line to the first pixel electrode; a second switching element driven by a scanning signal from the (n+1)-th scanning line, the second switching element being for controlling turning ON/OFF of the first switching element; a third switching element driven by the scanning signal from the (n+1)-th scanning line, the third switching element being for controlling a supply of the display signal from the specified signal line to the second pixel electrode; a fourth switching element driven by the scanning signal from the (n+2)-th scanning line, the fourth switching element being for controlling turning ON/OFF of the first switching element; and a charge capacitor connected to the third switching element, the charge capacitor being capable of holding charges given to the third switching element.

The present invention provides an image display apparatus which comprises: a plurality of signal lines for supplying display signals; a plurality of scanning lines for supplying scanning signals; a pixel electrode supplied with a display signal from a specified signal line; a storage capacitor arranged between the pixel electrode and one of the scanning lines adjacent to the pixel electrode; a first switching element connected to the pixel electrode; and a second switching element for controlling turning ON/OFF of the first switching element. Furthermore, the present invention provides an image display apparatus which comprises: signal lines for supplying display signals; scanning lines for supplying scanning signals; a pixel electrode supplied with a display signal from a specified signal line; and a storage capacitor arranged between the pixel electrode and one of the scanning lines adjacent to the pixel electrode, wherein the pixel electrode is driven by the scanning signals supplied from at least two scanning lines excluding the one of the scanning lines.

The present invention provides a method of driving the image display device described above. Specifically, the method of driving the image display device of the present invention, which comprises: a plurality of signal lines for supplying display signals; a plurality of scanning lines for supplying scanning signals; a first pixel electrode arranged between a n-th scanning line and a (n+1)-th scanning line (n: arbitrary positive integer), the first pixel electrode being connected to a specified signal line; a second pixel electrode arranged between the n-th scanning line and the (n+1)-th scanning line with the specified signal line interposed between the first and second pixel electrodes, the method comprising the steps of: supplying a first display signal to the specified signal line, the first display signal having a first potential to be given to the first pixel electrode, for a period from the time when potentials of the (n+1)-th scanning line and a (n+m)-th scanning line (m: integer excluding 0 and 1) become equal to a selection potential to the time when the potential of the (n+m)-th scanning line becomes equal to a non-selection potential, thus giving the first potential to the first and second pixel electrodes; and supplying a second display signal to the specified signal line, the second display signal having a second potential to be given to the second pixel electrode, after the potential of the (n+m)-th scanning line becomes equal to the non-selection potential, thus giving the second potential to the second pixel electrode.

BRIEF DESCRIPTION OF DRAWINGS

For a more complete understanding of the present invention and the advantages thereof, reference is now made to the following description taken in conjunction with the accompanying drawings.

DETAILED DESCRIPTION

Figure 28:
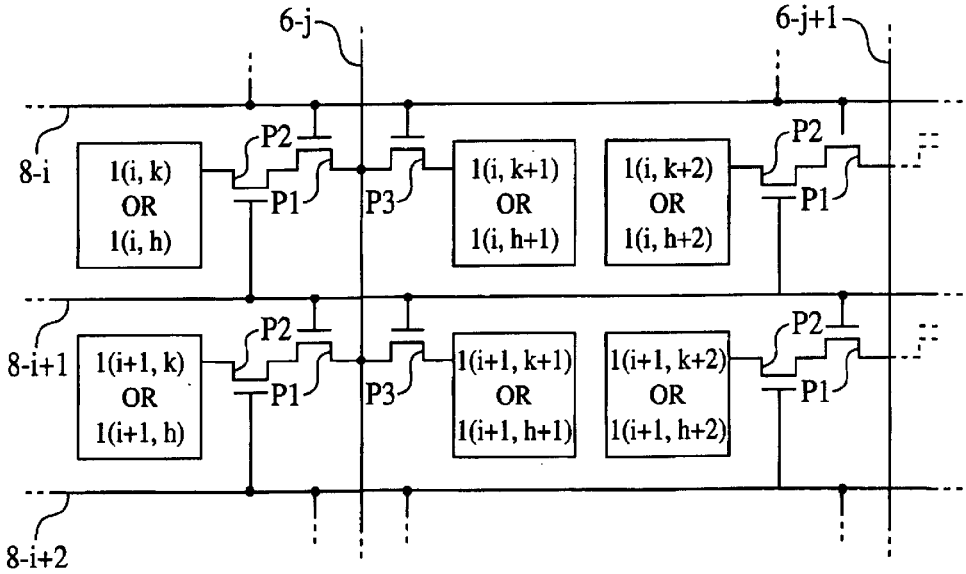
FIG. 28 (PRIOR ART)
FIG. 28 is a drawing showing the circuit construction of an array substrate as disclosed in the prior art.

The inventors of the present invention found the following fact as a result of investigations for the circuit shown in FIG. 28. Since the TFT P1 and the TFT P2 are connected in series in the circuit shown in FIG. 28, sizes of the TFT P1 and the TFT P2 must be doubled to obtain desired current compared to the conventional one in which one TFT is used. When the size of the TFT becomes large, an area of a pixel is reduced depending on an increase of the size of the TFT, resulting in a reduction of a pixel aperture ratio. Furthermore, in the circuit shown in FIG. 28, also when a storage capacitor necessary for the pixel electrode is provided between the pixel electrode and each of two scanning lines adjacent to the pixel electrode, a scanning line potential changes significantly from a selection potential to a non-selection potential immediately after a potential is supplied from the signal line to the pixel electrode. Therefore, a pixel potential changes significantly, and the pixel potential cannot be controlled precisely. This is a serious problem in terms of image quality. It is inferred from the above described problems that the proposals disclosed in Japanese Patent Laid-Open Gazette No. 265045/1993 and the like have not been put into practical use until now.

The image display device of the first aspect of the present invention can supply the display signal from a common predetermined signal line to the first and second pixel electrodes. Accordingly, in the case where pixels composed of M columns are present, the number of the signal lines, that is, the number of data drivers, can be made to be M/2.

The image display device of the first aspect of the present invention adopts the construction in which the second switching element is arranged between the predetermined scanning line and the gate electrode of the first switching element arranged between the first pixel electrode and the predetermined signal line. Specifically, two switching elements are never arranged between the first pixel electrode and the predetermined signal line. Therefore, a switching element typified by a TFT needs not to be large-sized. On the other hand, the third switching element is connected to the second pixel electrode, and the display signal from the signal line can be supplied to the second pixel electrode when the third switching element is turned on.

Descriptions for the two pixel electrodes that are the first and second pixel electrodes were made. However, the concept of the present invention can be applied to an embodiment in which three or more pixel electrodes share one signal line. As a matter of course, the present invention incorporates this embodiment.

According to the image display device of the first aspect of the present invention, a storage capacitor can be formed between a scanning line and each of the first and second pixel electrodes, the scanning line having nothing to do with the drives of the first and second pixel electrodes. Accordingly, deterioration of an image quality can be prevented. To be more specific, the storage capacitor can be formed between each of the first and second pixel electrodes and the predetermined scanning line located at the front stage of the first and second pixel electrodes. Herein, the front stage means a direction inverse to a scanning direction, and a rear stage means the scanning direction.

The image display device of the second aspect of the present invention can supply the display signal from the signal line common to the first and second pixel electrodes to these two pixel electrodes. Accordingly, when pixels of M columns exist, the number of signal lines, that is, the number of data drivers can be reduced to M/2.

In the image display device of the second aspect of the present invention, the first and second switching elements are connected to the first pixel electrode. When these two switching elements are turned on, the display signal from the signal line is supplied to the first pixel electrode. Herein, the first switching element is connected to the signal line, and the second switching element is connected to the first switching element and the first scanning line. Specifically, it is unnecessary to adopt a structure in which two switching elements are arranged in series between the first pixel electrode and the signal line. To be more specific, in the image display device of the present invention, the first switching element directly connects the first pixel electrode and the signal line. Consequently, it is unnecessary to make the switching element typified by a TFT large-sized. On the other hand, the third switching element is connected to the second pixel electrode, and the display signal from the signal line can be supplied to the second pixel electrode when the third switching element is turned on.

In the image display device of the second aspect of the present invention, the first scanning line can be disposed at the rear stage of the first and second pixel electrodes, and the second scanning line can be disposed at the rear stage of the first scanning line. With such a constitution, the first and second pixel electrodes are driven by the scanning lines disposed at the rear stage of them. In this case, when the scanning line positioned at the front stage of the first and second pixel electrodes is referred to as a third scanning line, the storage capacitor can be formed between each of the first and second pixel electrodes and the third scanning line. Since the third scanning line has nothing directly to do with operations-of the first and second pixel electrodes, formation of the storage capacitor between each of the first and second pixel electrodes and the third scanning line causes no deterioration of image quality.

However, according to the image display device of the second aspect of the present invention, it is possible to arrange the first scanning line at the front stage of the first and second pixel electrodes and to arrange the second scanning line at the rear stage of the first and second pixel electrodes. Also in this case, the present invention can enjoy an advantage that it is unnecessary to adopt a structure that two switching elements are arranged in series between the first pixel electrode and the signal line.

Furthermore, the image display device of the second aspect of the present invention is capable of comprising a fourth switching element connected to the third switching element, the fourth switching element being supplied with the scanning signal from the second scanning line. By equalizing the numbers of the switching elements respectively connected to the first and second pixel electrodes, uniformity of electrical characteristics between the pixels can be enhanced.

In the image display device of the third aspect of the present invention, the first and second pixel electrodes share the specified signal line, and the display signal is supplied from the specified signal line to the first and second pixel electrodes. Furthermore, in this image display device, the scanning signal is supplied to the first pixel electrode when the (n+1)-th scanning line and (n+m)-th scanning line (m: integer excluding 0 and 1) are simultaneously being selected. The scanning signal is supplied to the second pixel electrode when the (n+1)-th scanning line is being selected. Accordingly, a storage capacitor can be formed between each of the first and second pixel electrodes and the scanning line, which has nothing to do with the drives, at the front stage of the first and second pixel electrodes by selecting the value of m.

In this image display device, the first switching mechanism can be constituted of a first switching element connected to the specified signal line, the first switching element being driven by the scanning signal supplied from the (n+1)-th scanning line, and a second switching element connected to the first switching element, the second switching element being driven by the scanning signal supplied from the (n+m)-th scanning line.

The image display apparatus of the present invention can constitute a circuit by the M pixel columns and the M/2 signal lines provided for these pixel columns, so that a low cost and a high definition can be preferably achieved. Since this image display apparatus of the present invention adopts the above described circuit construction, two switching elements need not to be arranged in series between the first pixel electrode and the specified signal line. In addition, since the first and second pixel electrodes are driven by the scanning signals from the (n+1)-th and (n+2)-th scanning lines disposed at the rear stage of the first and second electrodes, a storage capacitor can be formed between each of the first and second pixel electrodes and a scanning line at the front stage of the first and second pixel electrodes.

This image display apparatus can comprise a fourth switching element driven by the scanning signal from the (n+2)-th scanning line, the fourth switching element being for controlling turning ON/OFF of the third switching element. With the provision of the fourth switching element, uniformity of electrical characteristics among the pixels can be enhanced by equalizing the numbers of the switching elements respectively connected to the first and second pixel electrodes.

The image display apparatus of the present invention can constitute a circuit by the M pixel columns and the M/2 signal lines provided for these pixel columns, so that a low cost and a high definition can be preferably achieved. Since this image display apparatus of the present invention adopts the above described circuit constitution, the first and second pixel electrodes are driven by the scanning signals from the (n+1)-th and (n+2)-th scanning lines disposed at the rear stage of the first and second electrodes. Therefore, a storage capacitor can be formed between each of the first and second pixel electrodes and a scanning line at the front stage of the first and second pixel electrodes, that is, the n-th scanning line.

The image display apparatus of the present invention can constitute a circuit by the M pixel columns and the M/3 signal lines provided for these pixel columns, so that a low cost and a high definition can be preferably achieved. Since this image display apparatus of the present invention adopts the above-described circuit construction, two switching elements need not to be arranged in series respectively between the first pixel electrode and the specified signal line, as well as between the third pixel electrode and the specified signal line. In addition, the first, second and third pixel electrodes are driven by the scanning signals from the (n+1)-th, (n+2)-th and (n+3)-th scanning lines disposed at the rear stage of the first, second and third pixel electrodes. Therefore, a storage capacitor can be formed between each of the first, second and third pixel electrodes and a scanning line at the front stage of the first, second and third pixel electrodes.

In the image display apparatus of the present invention, the signal line driving circuit can sequentially supply the specified signal line with a display signal having a potential to be given to the first pixel electrode, a display signal having a potential to be given to the second pixel electrode, and a display signal having a potential to be given to the third pixel electrode. Specifically, the predetermined potentials are given from the predetermined signal line to the three pixel electrodes time-divisionally.

The image display apparatus of the present invention can constitute a circuit by the M pixel columns and the M/2 signal lines provided for these pixel columns, so that a low cost and a high definition can be preferably achieved. Since this image display apparatus of the present invention adopts the above described circuit constitution, two switching elements need not to be arranged in series between the first pixel electrode and the specified signal line.

The image display apparatus of the present invention can constitute a circuit by the M pixel columns and the M/2 signal lines provided for these pixel columns, so that a low cost and a high definition can be preferably achieved. Since this image display apparatus of the present invention adopts the above described circuit constitution, two switching elements need not to be arranged in series between the first pixel electrode and the specified signal line. In addition, since the first and second pixel electrodes are driven by the scanning signals from the (n+1)-th and (n+2)-th scanning lines disposed at the rear stage of the first and second electrodes, a storage capacitor can be formed between each of the first and second pixel electrodes and a scanning line at the front stage of the first and second pixel electrodes. The image display apparatus of the present invention can equalize the numbers of the switching elements respectively connected to the first and second pixel electrodes. Accordingly, electrical characteristics among the pixel electrodes can be made uniform.

In the above descriptions of the image display apparatus of the present invention, the descriptions were made for the first and second pixel electrodes. However, it is apparent that the present invention has a novelty in the first pixel electrode itself.

An image display apparatus of the present invention will be described based on embodiments related to a liquid crystal display apparatus.

Figure 1:
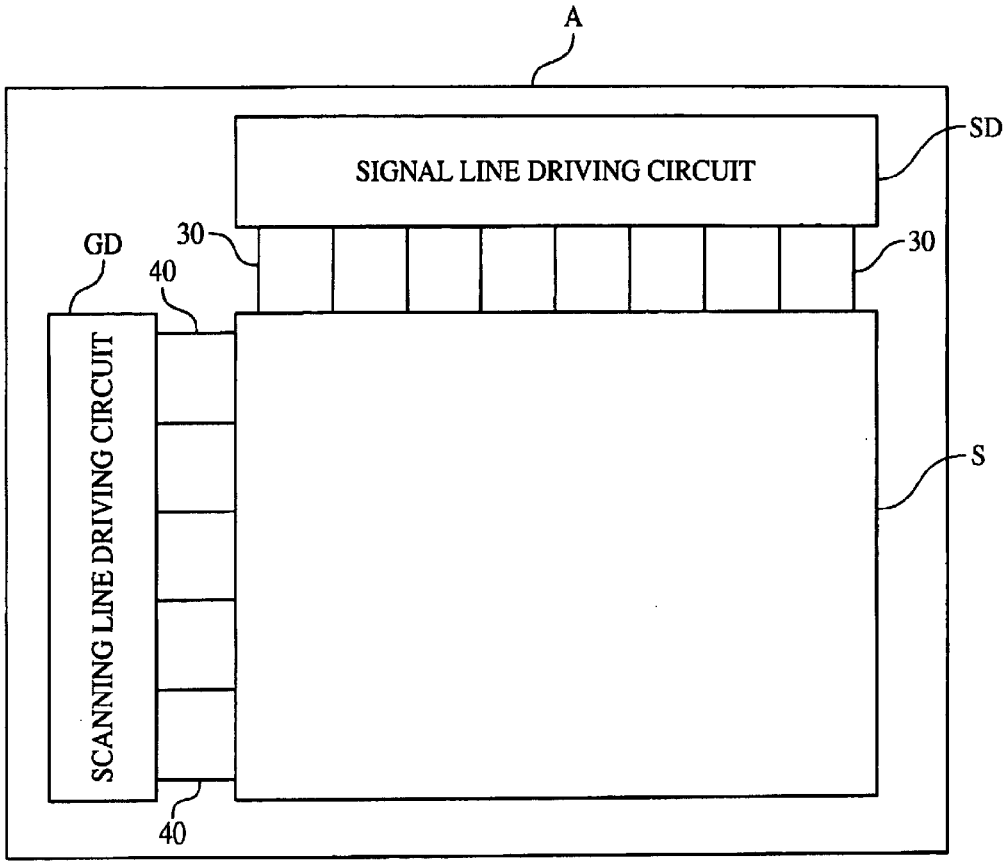
FIG. 1 is a schematic view showing the construction of a liquid crystal display apparatus according to the present invention.
Figure 2:
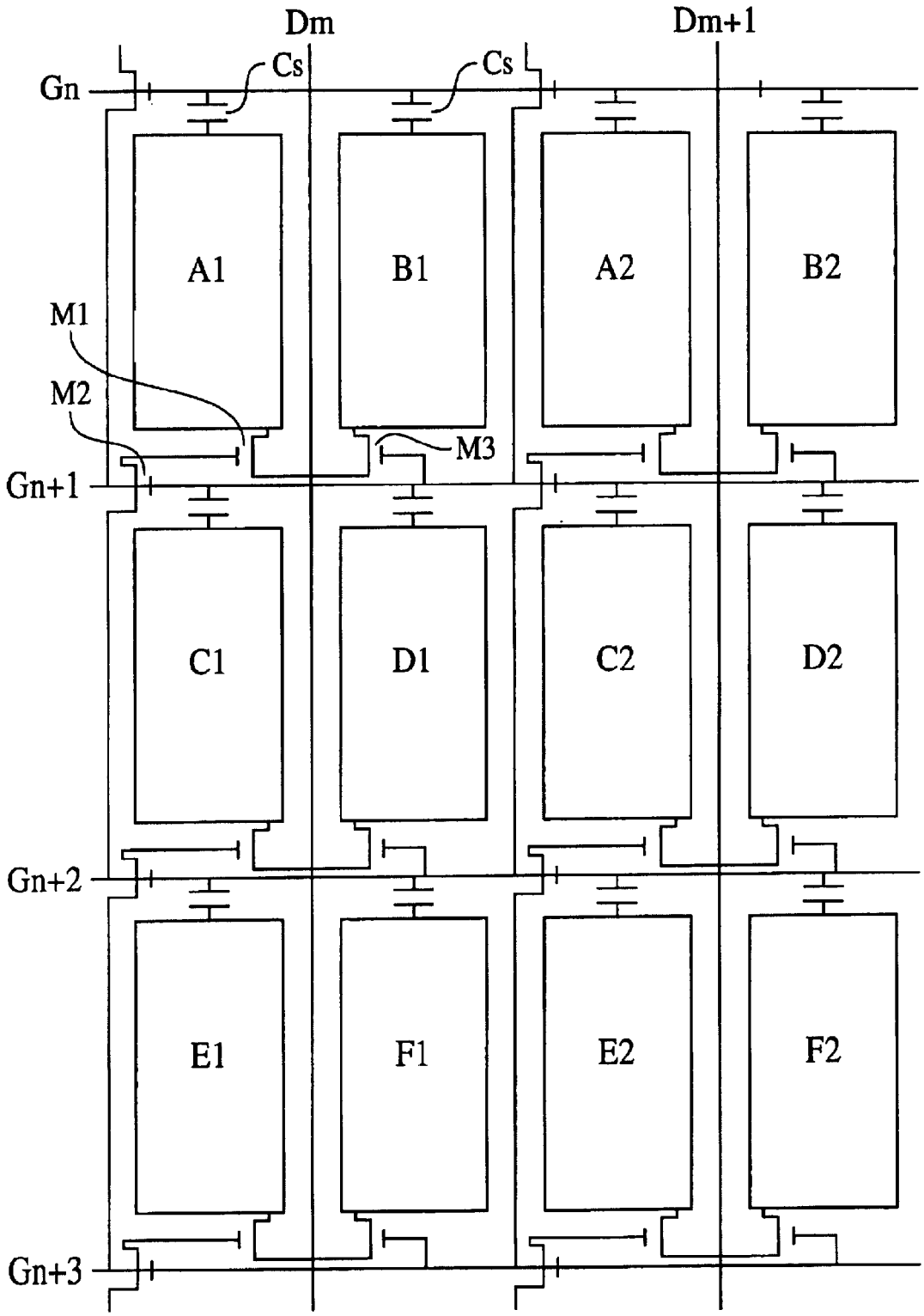
FIG. 2 is a drawing showing the construction of an array substrate A of the liquid crystal display apparatus of a first embodiment according to the present invention.

FIG. 1 is a schematic view showing the principal construction of an array substrate A as an image display device according to an embodiment of the present invention. FIG. 2 is a drawing showing the circuit construction of the array substrate A. FIGS. 3 to 6 are drawings showing an operation of the array substrate A. FIG. 7 is a timing chart of a scanning signal.

The liquid crystal display apparatus according to the embodiment is characterized in that two pixels adjacent to each other, which interpose one signal line therebetween, share this one signal line, and hence the number of signal lines is halved. As a matter of course, though the liquid crystal display device has to comprise other components such as a color filter substrate opposing to the array substrate and a backlight unit, these components do not represent characteristics of the present invention, and therefore descriptions for them are omitted.

As shown in FIG. 1, the array substrate A comprises: a signal line driving circuit SD for supplying a display signal to a pixel electrode through a signal line 30, the pixel electrode being arranged in a display area S, that is, for applying a voltage to the pixel electrode; and a scanning line driving circuit GD for supplying a scanning signal through a scanning line 40, which controls tuning ON/OFF of a TFT. On the array substrate A, arrayed are M×N pieces of pixel (M and N: any positive integer) in a matrix fashion.

In FIG. 2, for the pixel electrodes A1 and B1 adjacent to each other, which interpose the signal line Dm therebetween, three TFTs that are first to third TFTs M1, M2 and M3 are arranged in the following manner.

First, the first TFT M1 has a source electrode connected to the signal line Dm and a drain electrode connected to the pixel electrode A1. A gate electrode of the first TFT M1 is connected to a source electrode of the second TFT M2. Herein, the TFTs are three terminal switching elements. In the liquid crystal display apparatus, for example, a terminal of the TFT connected to the signal line is called a source electrode, and a terminal thereof connected to the pixel electrode is called a drain electrode. On the contrary, a terminal of the TFT connected to the pixel electrode is called a source electrode, and a terminal thereof connected to the signal line is called a drain electrode. Specifically, it is not uniquely determined that any of the two electrodes excluding the gate electrode is called the source electrode or the drain electrode. Accordingly, the two electrodes excluding the gate electrode shall be hereinafter called a source/drain electrode.

Next, the second TFT M2 has one source/drain electrode connected to the gate electrode of the first TFT M1 and the other source/drain electrode connected to a scanning line Gn+2. Accordingly, the gate electrode of the first TFT M1 is connected to the scanning line Gn+2 through the second TFT M2. A gate electrode of the second TFT M2 is connected to the scanning line Gn+1. Therefore, only during a period of time when the two scanning lines Gn+1 and Gn+2 adjacent to each other are simultaneously in a selection potential, the first TFT M1 is turned on, and a potential of the signal line Dm is supplied to the pixel electrode A1. This implies that the second TFT M2 controls the turning ON/OFF of the first TFT M1.

The third TFT M3 has one source/drain electrode connected to signal line Dm and the other source/drain electrode connected to a pixel electrode B1. Furthermore, a gate electrode of the third TFT M3 is connected to the scanning line Gn+1. Accordingly, when the scanning line Gn+1 is in the selection potential, the third TFT M3 is turned on, and the potential of the signal line Dm is supplied to the pixel electrode B1.

In the above descriptions, the circuit construction of the array substrate A was described in consideration of the arrangement of the first to third TFTs M1 to M3. Next, the circuit construction of the array substrate A will be described in consideration of the pixel electrodes A1 and B1.

A display signal is supplied from the single signal line Dm to the pixel electrodes A1 and B1. In other words, the signal line Dm is the one common to the pixel electrodes A1 and B1. Accordingly, while the pixels are arranged in a matrix of M rows and N columns, the number of the signal lines Dm is equal to M/2.

The first and second TFTs M1 and M2 are connected to the pixel electrode A1. The first TFT M1 is connected to the signal line Dm and connected to the second TFT M2. The gate electrode of the second TFT M2 is connected to the scanning line Gn+1 placed at the rear stage of the pixel electrode A1, and the source/drain electrode of the second TFT M2 is connected to the scanning line Gn+2 placed at the rear stage of the scanning line Gn+1. Herein, to supply a potential at the signal line Dm to the pixel electrode A1, the first TFT M1 needs to be turned on. The gate electrode of the first TFT M1 is connected to one source/drain electrode of the second TFT M2, the gate electrode of the second TFT M2 is connected to the scanning line Gn+1, and the other source/drain electrode of the second TFT M2 is connected to the scanning line Gn+2. Therefore, to turn on the first TFT M1, the second TFT M2 needs to be turned on and the scanning line Gn+2 needs to be selected. To turn on the second TFT M2, the scanning line Gn+1 needs to be selected. Accordingly, the first and second TFTs M1 and M2 constitute a switching mechanism which permits the scanning signal to pass therethrough when both of the scanning lines Gn+1 and Gn+2 are selected. Thus, the pixel electrode A1 is driven based on the scanning signal from the scanning line Gn+1 and the scanning signal from the scanning line Gn+2, and receives a potential at the signal line Dm.

The third TFT M3 is connected to the pixel electrode B1, and the gate electrode thereof is connected to the scanning line Gn+1. Accordingly, the pixel electrode A2 is supplied with the potential from the signal line Dm when the scanning line Gn+1 is selected.

In the above, the descriptions were made as to the pixel electrodes A1 and B1. The array substrate A has the same construction for the pixel electrodes A2 and B2, the pixel electrodes C1 and D1, the pixel electrodes C2 and D2, and other pixels, respectively.

Next, operations of the pixel electrodes A1 to D1 depending on selections and non-selections of the scanning lines Gn+1 to Gn+3 will be described with reference to the circuit diagrams shown in FIGS. 3 to 6 and the timing charts of the scanning signals shown in FIG. 7.

Dm(1) and Dm(2) shown in FIG. 7 denote potentials of a data signal supplied by the signal line Dm, and show timing at which the data signal changes. These Dm(1) and Dm(2) include changes of a polarity and a gray scale. Therefore, if Dm(1) and Dm (2) is seized as the change of the polarity, in the case of the operations by a supply of Dm(1), the polarities of the pixel electrodes A1 and B1 are different from each other, and the polarities of the pixel electrodes A1 and C1 are identical to each other. On the other hand, in the case of the operations by a supply of Dm(2), the polarities of the pixel electrodes A1 and B1 are identical to each other, and the polarities of the pixel electrodes A1 and C1 are different from each other.

Furthermore, in FIG. 7, the diagrams of the scanning lines Gn to Gn+3 show a selection and a non-selection of the scanning lines Gn to Gn+3. To be concrete, the parts where the diagram rises up show a state where the scanning line is selected. The parts where the diagram does not rise up show a state where the scanning line is not selected.

Figure 3:
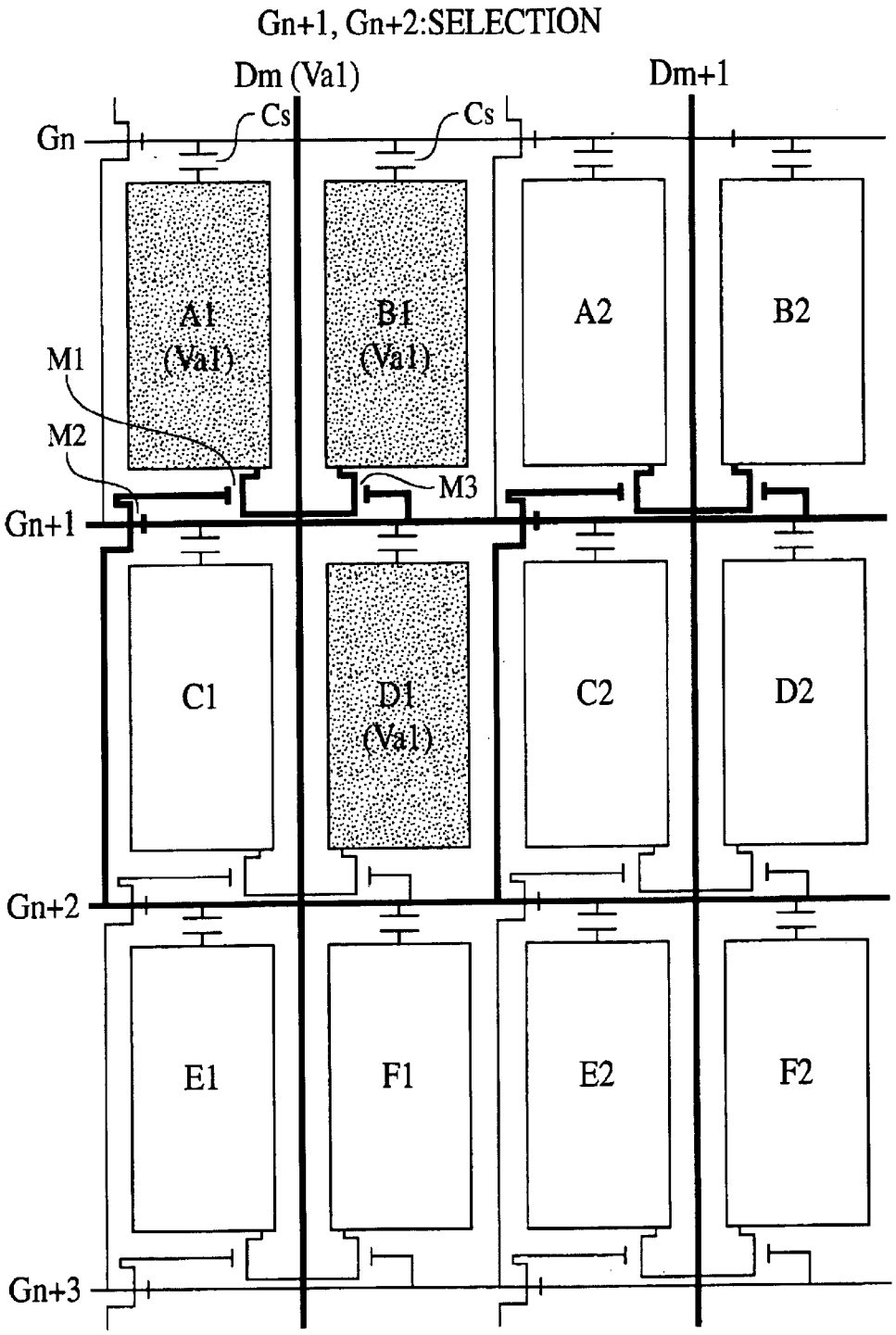
FIG. 3 is a drawing showing an operation of the array substrate A of the liquid crystal display apparatus of the first embodiment according to the present invention.

As shown in FIG. 3 and FIG. 7, for a period (t1) from the time when both of the scanning lines Gn+1 and Gn+2 are selected to the time when the potential of the scanning line Gn+2 becomes equal to the non-selection potential, the TFTs M1 to M3 are being turned on. Noted that in FIG. 3, the thick lines show the state where the scanning lines Gn+1 and Gn+2 are selected. A potential Va1 to be applied to the pixel electrode A1 from the signal line Dm is supplied to the pixel electrodes A1, B1 and D1 as shown in FIG. 3. Herein, the potential Va1 of the pixel electrode A1 is determined.

After the potential of the scanning line Gn+2 becomes equal to the non-selection potential, the potential supplied from the signal line Dm changes to the potential Vb1 to be supplied to the pixel electrode B1.

Figure 4:
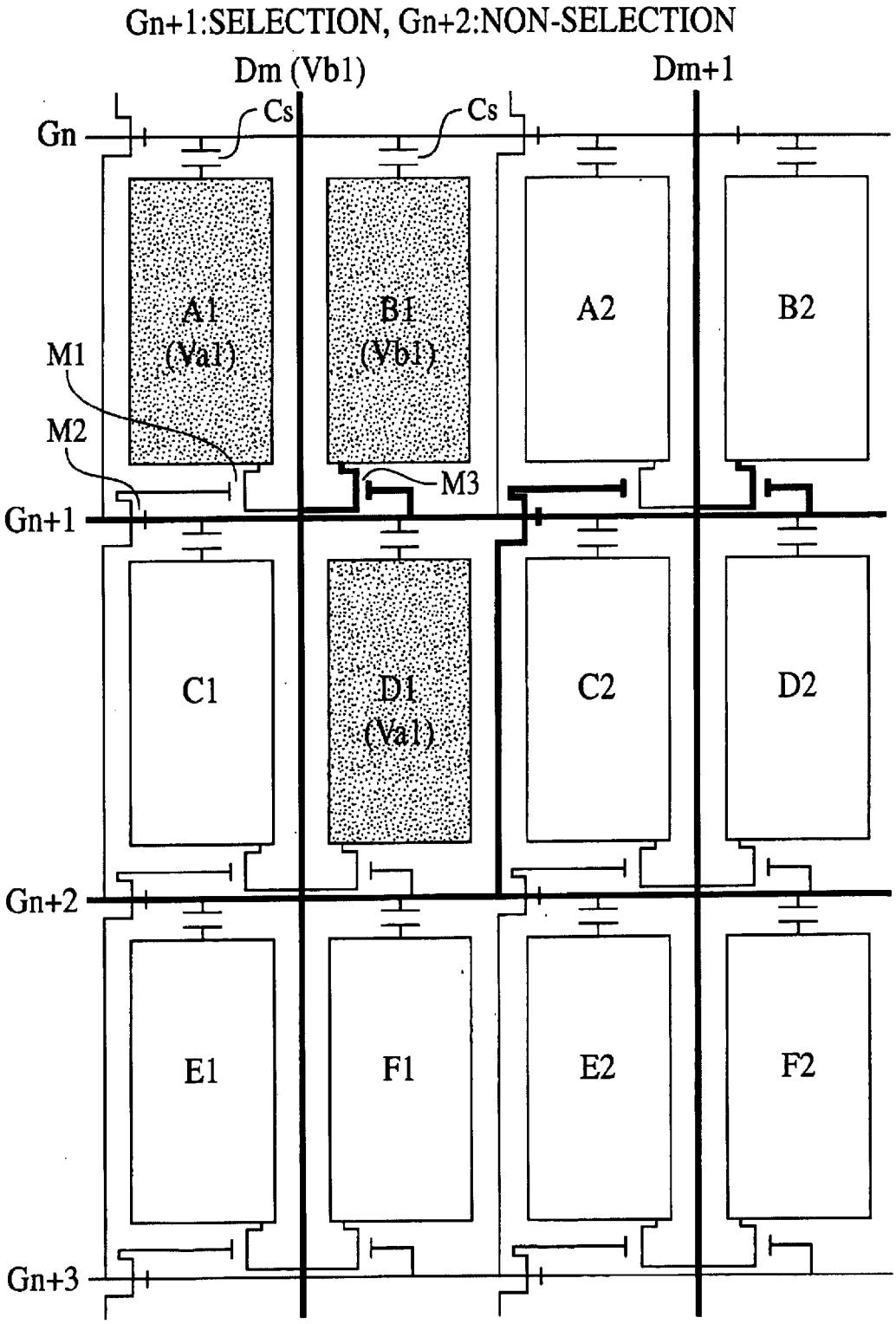
FIG. 4 is a drawing showing an operation of the array substrate A of the liquid crystal display apparatus of the first embodiment according to the present invention.

As shown in FIG. 4, the potential Vb1 is supplied to the pixel electrode B1 by keeping the scanning line Gn+1 at the selection potential continuously for a period (t2) after the potential of the scanning line Gn+2 becomes equal to the non-selection potential as shown in FIG. 7. Thus, the potential of the pixel electrode B1 is determined. As described above, the potential of the signal line Dm is supplied to the pixel electrodes A1 and B1 time-divisionally.

After the potential of the scanning line Gn+1 becomes equal to the non-selection potential, the potential of the signal line Dm changes to the potential Vc1 to be supplied to the pixel electrode C1.

Figure 5:
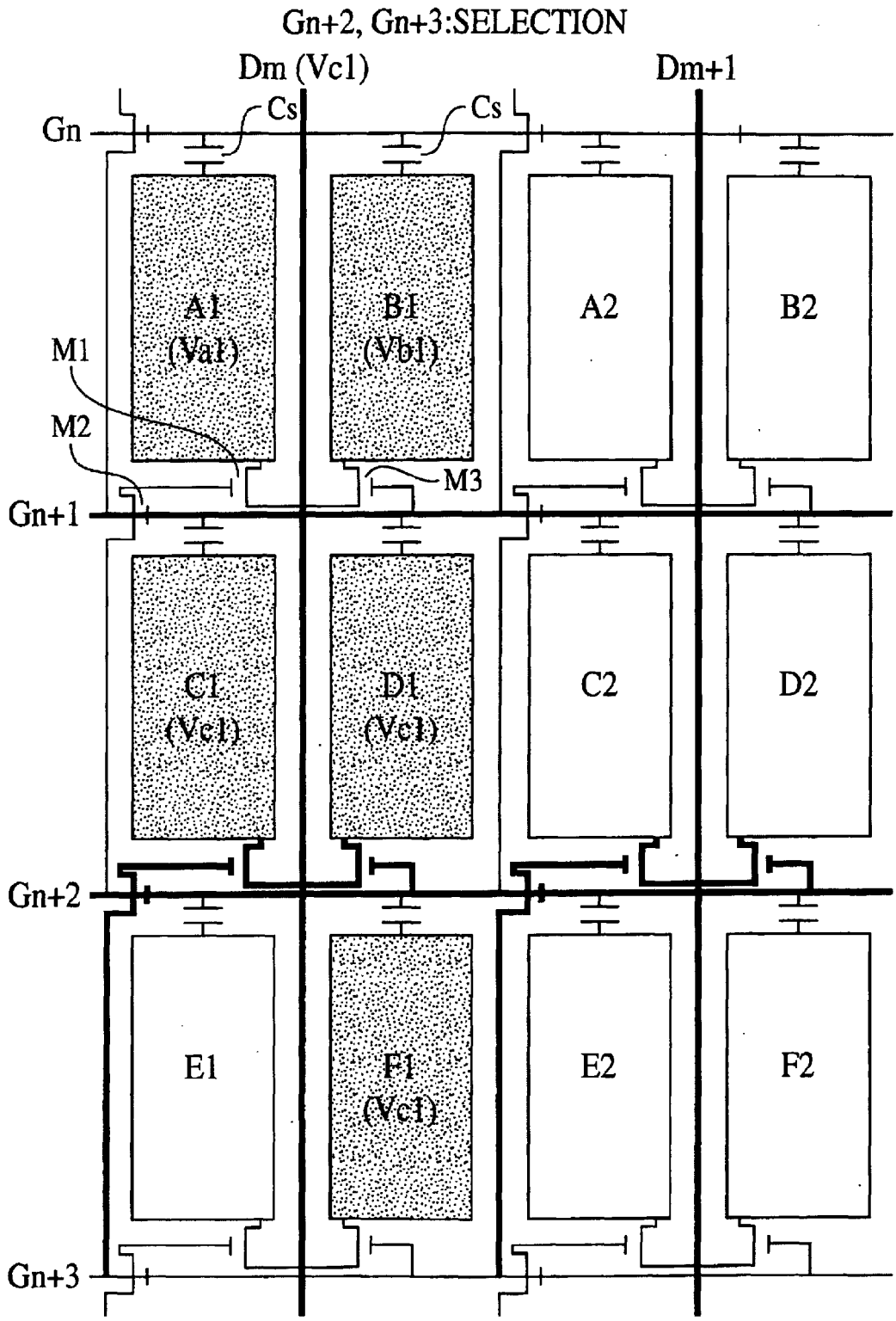
FIG. 5 is a drawing showing an operation of the array substrate A of the liquid crystal display apparatus of the first embodiment according to the present invention.

Furthermore, as shown in FIG. 7, for a period (t3) after the potential of the scanning line Gn+1 becomes equal to the non-selection potential, when the potential of the scanning line Gn+2 becomes again equal to the selection potential and the potential of the scanning line Gn+3 becomes equal to the selection potential, the potential Vc1 is applied to the pixel electrodes C1, D1 and F1 as shown in FIG. 5. Herein, the potential Vc1 of the pixel electrode C1 is determined.

After the potential of the scanning line Gn+3 becomes equal to the non-selection potential, the potential supplied from the signal line Dm changes to the potential Vd1 to be supplied to the pixel electrode D1.

Figure 6:
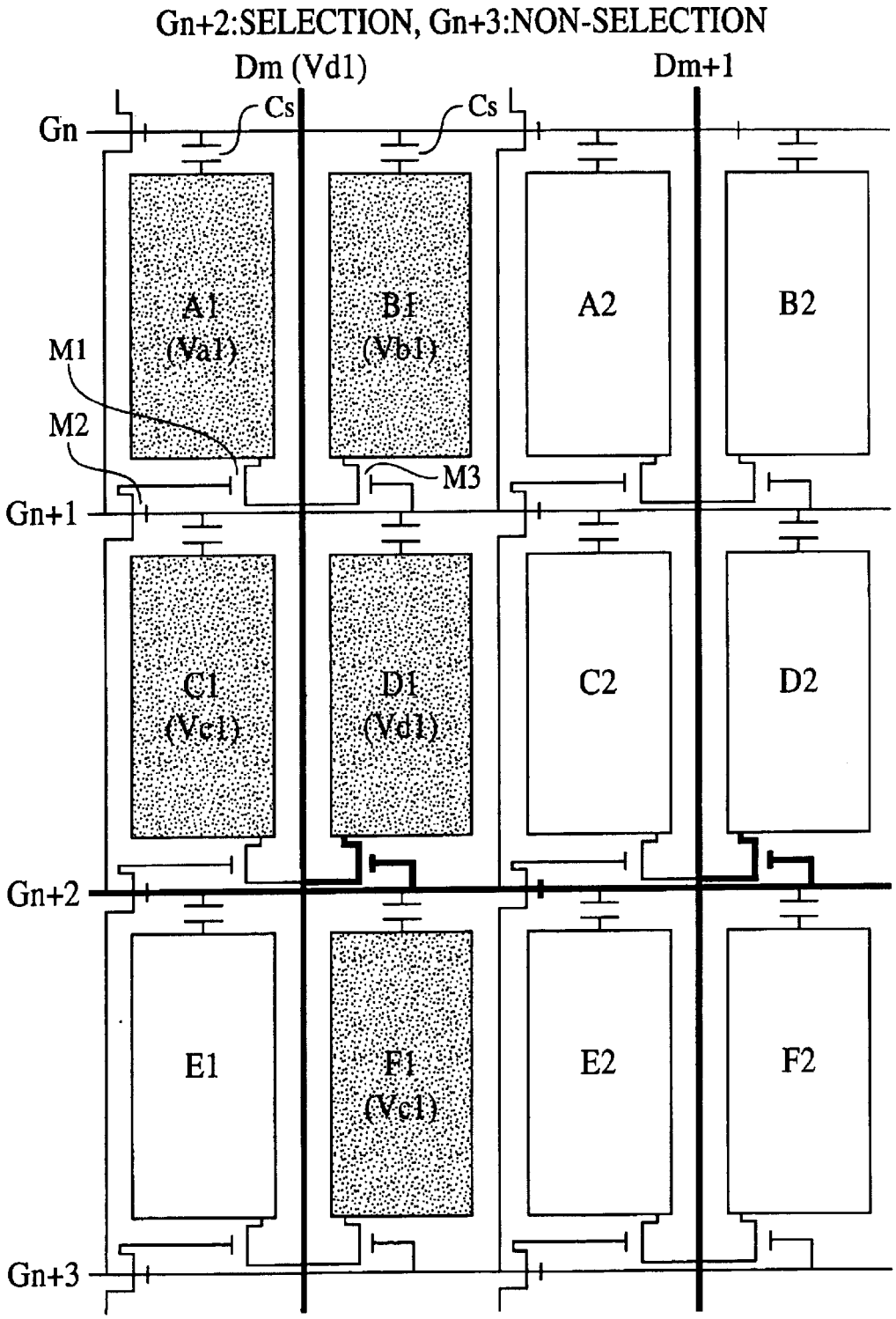
FIG. 6 is a drawing showing an operation of the array substrate A of the liquid crystal display apparatus of the first embodiment according to the present invention.
Figure 7:
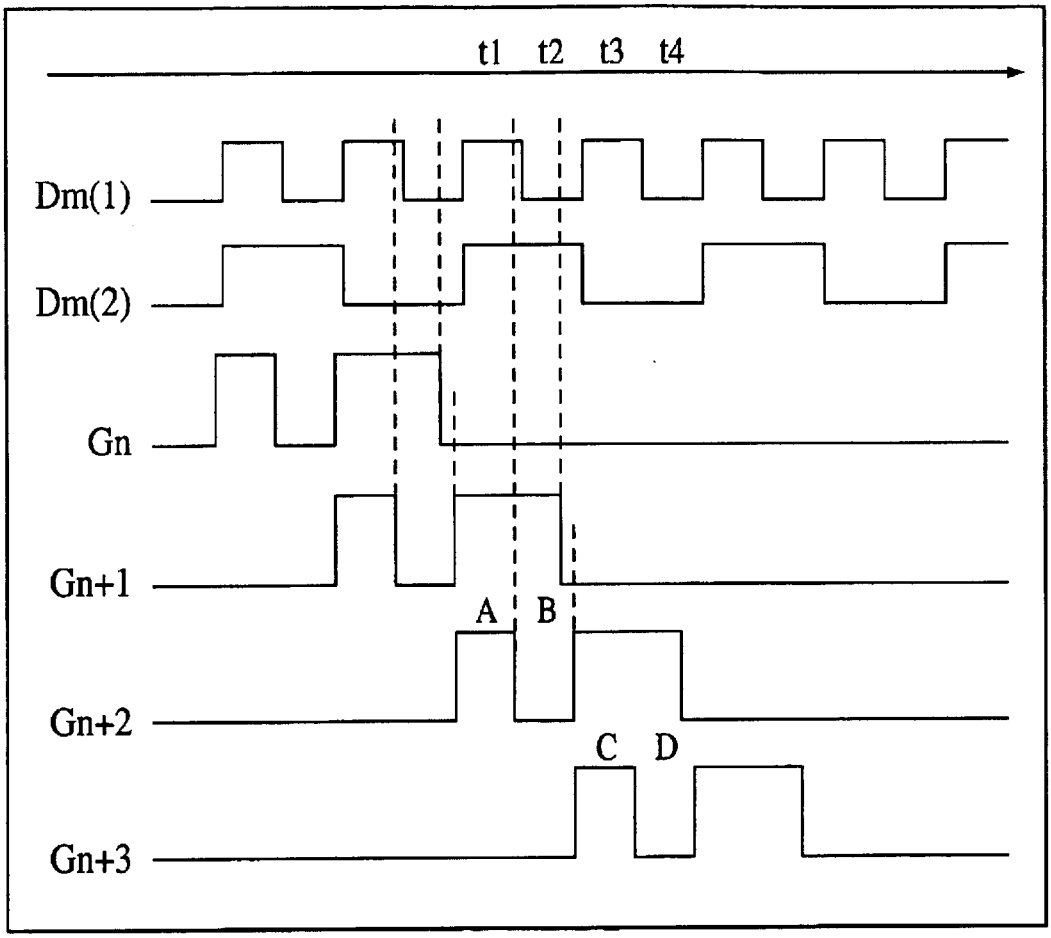
FIG. 7 is a drawing showing a timing chart of a scanning signal of the liquid crystal display apparatus of the first embodiment according to the present invention.

As shown in FIG. 7, the potential of the scanning line Gn+2 is kept at the selection potential continuously for a period (t4) after the potential of the scanning line Gn+3 becomes equal to the non-selection potential, whereby the potential Vd1 is supplied to the pixel electrode D1 and the potential of the pixel electrode D1 is determined as shown in FIG. 6.

The liquid crystal display apparatus according to the first embodiment adopts the construction in which the driving potential is supplied from one signal line, for example, the signal line Dm, to the two pixel electrodes A1 and B1 adjacent to each other, which interpose the signal line Dm therebetween. Accordingly, the liquid crystal display apparatus of the first embodiment can halve the number of the signal lines, that is, the number of the data drivers, compared to the conventional liquid crystal display apparatus in which the pixel and the signal line correspond to each other with a one-to-one correspondence relation. In addition, in the liquid crystal display apparatus of the first embodiment, the first TFT M1 connected to the pixel electrode A1 and the third TFT M3 connected to the pixel electrode B1 are directly connected to the common signal line Dm. Accordingly, unlike the circuit construction shown in FIG. 28, disclosed in Japanese Patent Laid-Open Gazette No. 265045/1993, in which the two TFTs are connected in series between the signal line and the pixel electrode, it is unnecessary to design the TFT to be large-sized, in order to secure a desired current. Specifically, according to the first embodiment, the first and third TFTs M1 and M3 as the switching element can be fabricated to be small-sized compared to the liquid crystal display apparatus disclosed in Japanese Patent Laid-Open gazette No. 265045/1993.

In the liquid crystal display apparatus according to the first embodiment, the storage capacitor Cs is provided between the pixel electrode and the scanning line at the front stage of this pixel electrode. Specifically, as shown in FIG. 2, the storage capacitor Cs of each of the pixel electrodes A1, B1, A2 and B2 is provided between the scanning line Gn and the corresponding one of the pixel electrodes A1, B1, A2 and B2, respectively. The storage capacitor Cs of each of the pixel electrodes C1, D1, C2 and D2 is provided between the scanning line Gn+1 and the corresponding one of the pixel electrodes C1, D1, C2 and D2. The scanning line Gn has nothing to do with drives of the pixel electrodes A1, B1, A2 and B2. The scanning line Gn+1 has nothing to do with drives of the pixel electrodes C1, D1, C2 and D2. Herein, the potential of the scanning line Gn never varies for a period when the potentials are respectively supplied from the signal lines Dm and Dm+1 to the pixel electrodes A1, B1, A2 and B2 and immediately after passage of that period.

Accordingly, the variations of the pixel potentials in the pixel electrodes A1, B1, A2 and B2 are avoidable, which implies that the pixel potential can be controlled with a high precision. The precise control of the pixel potential is significant advantage in terms of image quality, and thus a high quality image can be provided. The characteristics of this embodiment in which the storage capacitor Cs can be placed between the pixel electrode and the scanning line at the front stage thereof can be enjoyed even in the case where two TFTs are connected in series between the signal line and the pixel like the second embodiment of the present invention.

In the circuit construction shown in FIG. 28, disclosed in Japanese Patent Laid-Open Gazette No. 265045/1993, one of the two TFTs is connected to the scanning line at the front stage thereof. Accordingly, in the circuit construction disclosed in Japanese Patent Laid-Open Gazette No. 265045/1993, when the storage capacitor is arranged between the pixel electrode and the scanning line at the front stage thereof, the potential of the scanning line at the front stage of that pixel electrode varies for a period when the potential from the signal line is supplied to that pixel. Thus, the pixel potential varies.

To avoid the variation of the pixel potential, the structure may be adopted, in which the storage capacitor is not constituted by a part of the scanning line, but constituted independently. However, the independent formation of the storage capacitor causes a decrease in a pixel aperture ratio, and changes or additions of processes in fabricating the array substrate may be necessary. Accordingly, the first embodiment is the desired one from the viewpoints of the aperture ratio and the manufacturing process. However, the formation of the independent storage capacitor Cs is never denied in the present invention.

A liquid crystal display apparatus of the second embodiment of the present invention will be described below.

The liquid crystal display apparatus of the second embodiment is the same as that of the first embodiment except that the first and second TFTs M11 and M12 are connected to the pixel electrode A11 in a different manner from that of the first embodiment. Accordingly, the difference of the connections between the first and second embodiments will be mainly described.

Figure 8:
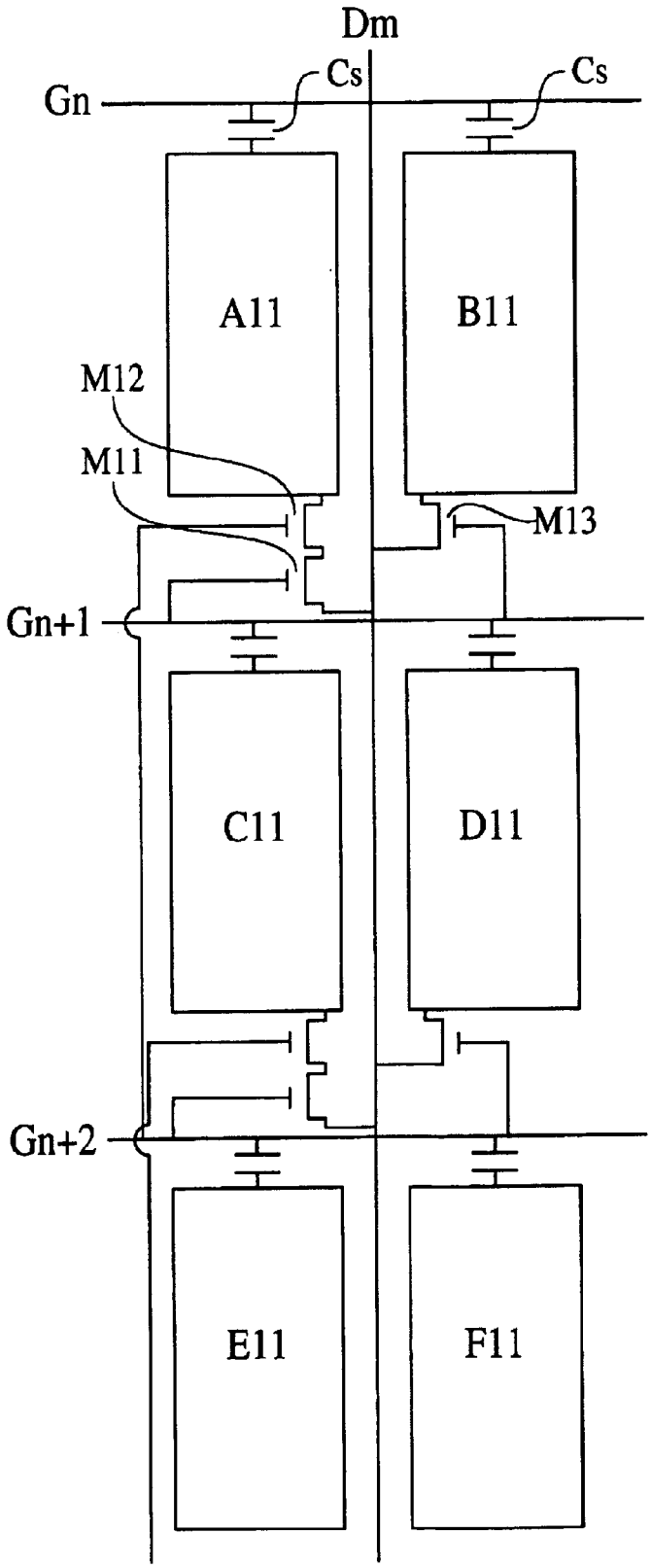
FIG. 8 is a drawing showing the construction of an array substrate A of a liquid crystal display apparatus of a second embodiment according to the present invention.

FIG. 8 shows the circuit construction of the array substrate A according to the second embodiment.

The three TFTs of the first TFT M11, the second TFT M12 and the third TFT M13 are arranged for the pixel electrodes A11 and B11 in the following manner, which are adjacent to each other so as to interpose the signal line Dm therebetween.

First, the first TFT M11 has one source/drain electrode connected to the signal line Dm, and the other source/drain electrode of the first TFT M11 is connected to a source/drain electrode of the second TFT M12. Furthermore, a gate electrode of the first TFT M1 is connected to the scanning line Gn+1.

Next, one source/drain electrode of the second TFT M12 is connected to the first TFT M11, and the other source/drain electrode of the second TFT M12 is connected to the pixel electrode A11. A gate electrode of the second TFT M12 is connected to the scanning line Gn+2. Accordingly, the first and second TFTs M11 and M12 are turned on only for a period when the two scanning lines Gn+1 and Gn+2 adjacent to each other are simultaneously kept at the selection potential, and the potential of the signal line Dm is supplied to the pixel electrode A11. This implies that the first and second TFTs M11 and M12 are provided on a path for supplying the data potential to the pixel electrode A11, and the first and second TFTs M11 and M12 are turned on when the potentials of the two scanning lines Gn+1 and Gn+2 disposed at the rear stage of the pixel electrode A11 become equal to the selection potential. When the first and second TFTs M11 and M12 are turned on, the data potential from the signal line Dm is supplied to the pixel electrode A11.

One source/drain electrode of the third TFT M13 is connected to the signal line Dm and the other source/drain electrode thereof is connected to the pixel electrode B11. The gate electrode of the third TFT M13 is connected to the scanning line Gn+1. Accordingly, when the potential of the scanning line Gn+1 is equal to the selection potential, the third TFT M13 is turned on, and the potential of the signal line Dm is supplied to the pixel electrode B11. In this respect, this embodiment is the same as the first embodiment.

Also in the second embodiment, the construction is adopted, in which the driving potential is supplied from one signal line, for example, the signal line Dm, to the two pixel electrodes A11 and B11 adjacent to each other so as to interpose this signal line. Accordingly, the number of the signal lines, that is, the data drivers, can be halved compared to the conventional liquid crystal display apparatus in which the pixel and the signal line correspond to each other with correspondence relation.

In addition, also in the liquid crystal display apparatus according to the second embodiment, the storage capacitor Cs is provided between the pixel electrode and the scanning line at the front stage of the pixel electrode. Specifically, as shown in FIG. 8, the storage capacitors Cs of the pixel electrode A11 and B11 are provided between the scanning line Gn and respective pixel electrodes A11 and B11. Accordingly, also in the liquid crystal display apparatus of the second embodiment, a high quality image can be provided.

A liquid crystal display apparatus of the third embodiment will be described below. The liquid crystal display apparatus of the third embodiment is the same as that of the first embodiment except that the first and second TFTs M21 and M22 are connected to the pixel electrodes C21 and D21 positioned at the rear stage of the pixel electrodes A21 and B21 in a different manner from that of the first embodiment.

Figure 9:
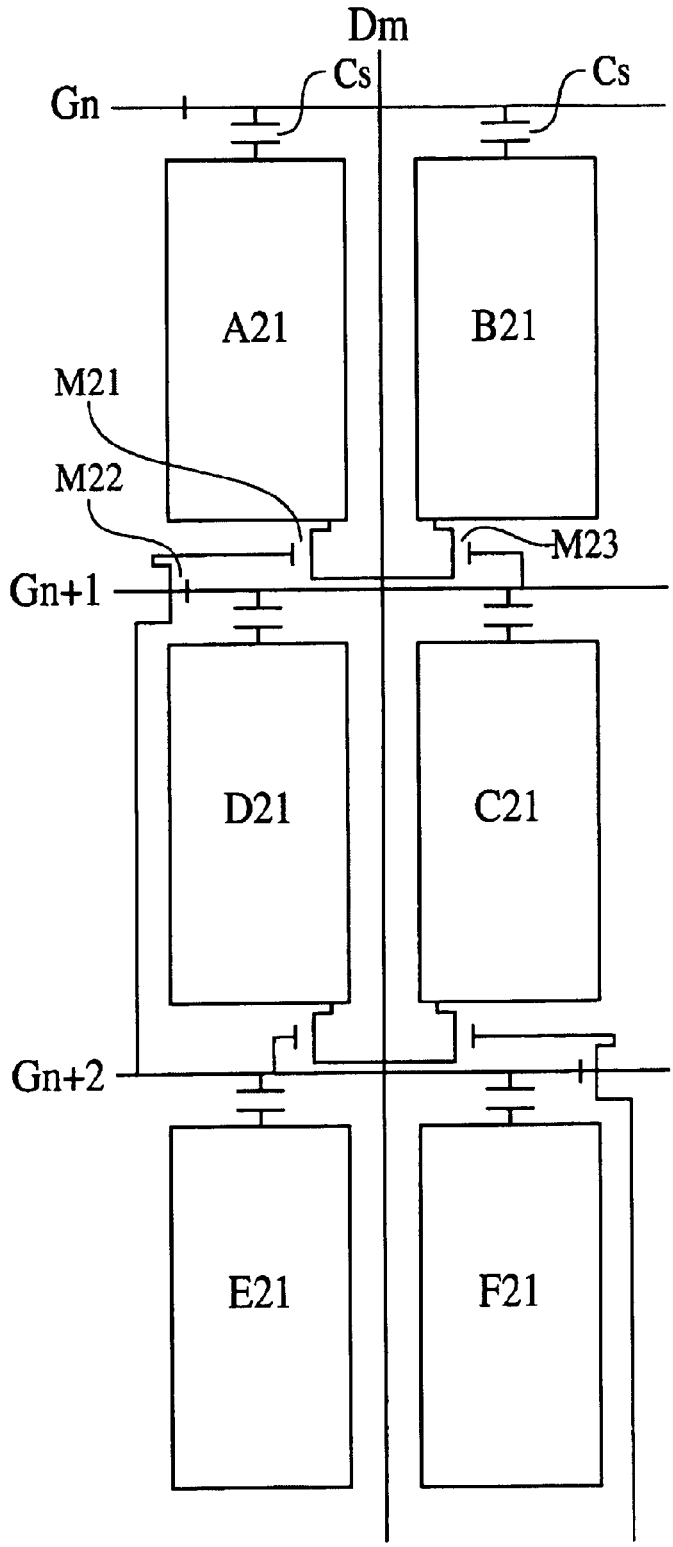
FIG. 9 is a drawing showing the construction of an array substrate A of a liquid crystal display apparatus of a third embodiment according to the present invention.

In the first embodiment, the pixels having the same construction including the method of connecting the first and second TFTs M1 and M2 as the pixel electrode A1 are arranged in the same column. However, in the third embodiment, the pixel having the same construction as the pixel electrode A21 is disposed at the positions which are respectively shown by the pixel electrodes C21 and the E21 as shown in FIG. 9. Moreover, the pixel having the same construction as the pixel electrode B21 is disposed at the positions which are respectively shown by the pixel electrodes D21 and F21. Specifically, while the pixels having the same construction are continuously arranged in the first embodiment, the pixels having the same construction are intermittently arranged in the same columns and the same rows in the third embodiment.

Also in the third embodiment, the structure is adopted, in which a driving potential is supplied to the two pixel electrodes A21 and B21 adjacent to each other so as to interpose one signal line Dm similarly to the first embodiment. Accordingly, it is possible to halve the number of the signal lines, that is, the data drivers. In addition, since the first TFT M21 connected to the pixel electrode A21 and the second TFT M22 connected to the pixel electrode B21 are directly connected to the signal line Dm, it is unnecessary to make the TFT large-sized to secure a desired current, and a liquid crystal display apparatus having a high aperture ratio can be obtained. Furthermore, since the storage capacitor Cs can be placed between the pixel electrode and the scanning line at the front stage of this pixel electrode, a high quality image can be provided.

The third embodiment shows the following two effects in addition to the same effects as those of the first embodiment.

One effect is that it is possible to design an image display device which minimizes an occupied area other than the aperture portion of the pixel. Herein, when the pixel in which the pixel electrode A21 exists and the pixel in which the pixel electrode B21 exists are compared, it is shown that the former pixel has a crowded structure compared to the latter pixel since the former pixel has the two TFTs of the first and second TFTs M21 and M22 formed thereon and the latter pixel has only one TFT M23 formed thereon. This crowded pixel causes an increase in an area of each pixel. In the first embodiment, the crowded pixels are continuously arranged in the same column, the area of the pixel tends to be larger. However, if the crowded pixel and the uncrowded pixel are sequentially arranged in the column direction like the third embodiment, the increase in the area of the crowded pixel can be canceled by the uncrowded pixel. Specifically, the occupied area other than the aperture portion of the pixel can be minimized.

Another effect is that uniformity of the liquid crystal display panel is enhanced. Since the pixel electrodes A21 and B21 have the different pixel structures, the pixel electrodes A21 and B21 have different electrical characteristics. According to the arrangement of the pixel electrodes A1, B1, . . . of the first embodiment, the pixel columns having the different electrical characteristics are arranged alternately. Accordingly, in an image displayed on such a liquid crystal display panel, difference in electrical characteristics become conspicuous. However, in the case where the pixels having the different electrical characteristics are arranged in a checked pattern as the third embodiment, the difference in electrical characteristics is inconspicuous in the displayed image.

A liquid crystal display apparatus of a fourth embodiment of the present invention will be described below.

While the two pixels share one signal line Dm in the first to third embodiments, three pixels share one signal line Dm in the fourth embodiment. Accordingly, the liquid crystal display apparatus of the fourth embodiment can reduce the number of the signal lines, that is, the number of the data drivers, to one-third, compared to the conventional liquid crystal display apparatus in which the pixel and the signal line correspond to each other with a one-to-one correspondence relation.

Figure 10:
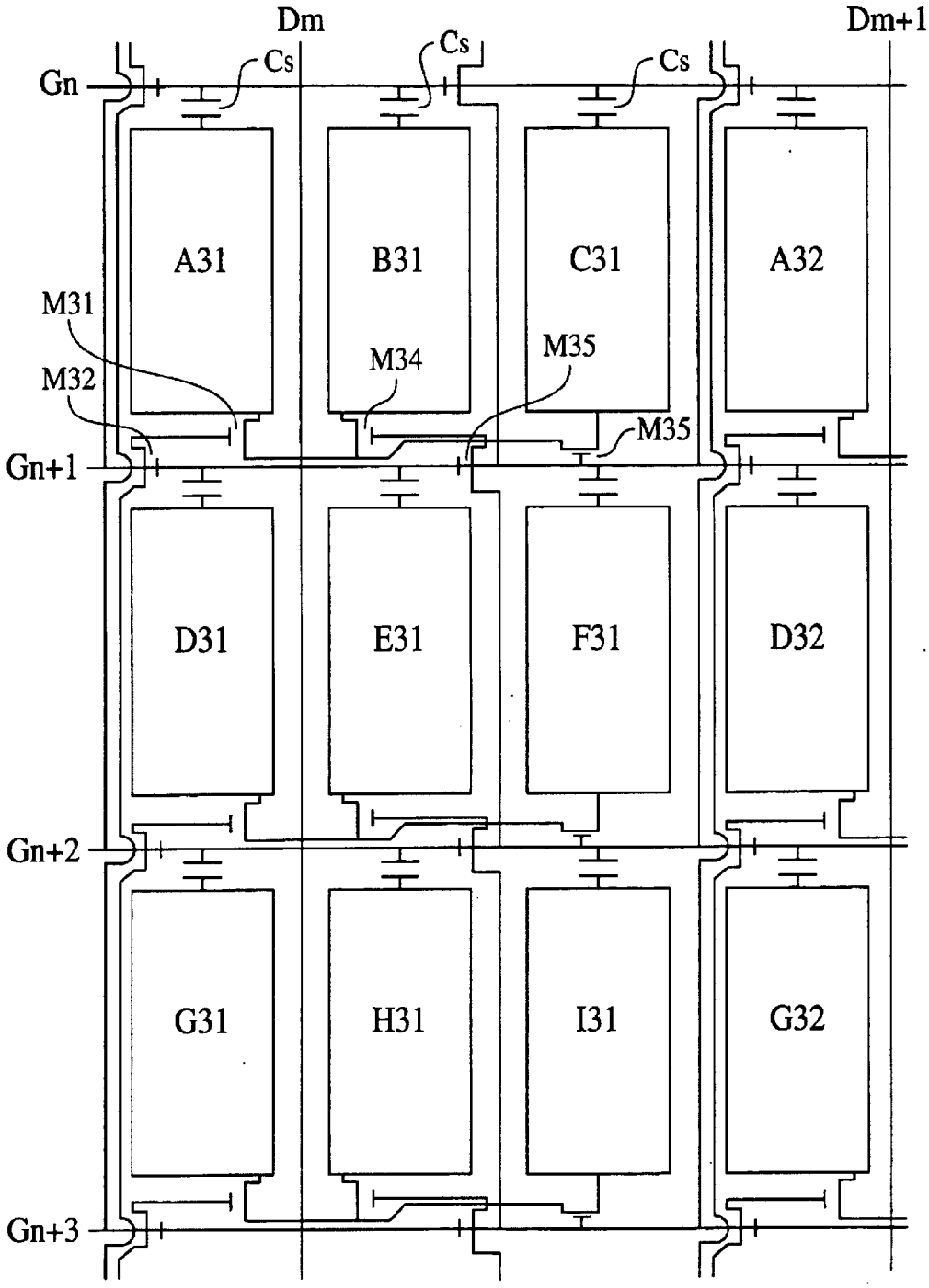
FIG. 10 is a drawing showing the construction of an array substrate A of a liquid crystal display apparatus of a fourth embodiment according to the present invention.

The construction of an array substrate A of the liquid crystal display apparatus according to the fourth embodiment is shown in FIG. 10.

In the fourth embodiment, the three pixels that are the pixel electrode A31 (pixel electrode D31, pixel electrode G31, . . . ), the pixel electrode B31 (pixel electrode E31, pixel electrode H31, . . . ) and the pixel electrode C31 (pixel electrode F31, pixel electrode I31, . . . ) share the signal line Dm. When the potentials of the scanning line Gn+1 and the scanning line Gn+3 become equal to the selection potential, the data potential of the signal line Dm is supplied to the pixel electrode A31. When the potentials of the scanning line Gn+1 and the scanning line Gn+2 become equal to the selection potential, the data potential of the signal line Dm is supplied to the pixel electrode B31. When the potential of the scanning line Gn+1 becomes equal to the selection potential, the data potential of the signal line Dm is supplied to the pixel electrode C31.

To perform the above-described operations, arrangements of the first to fifth TFTs M31 to M35 as a switching element are set as follows in the fourth embodiment.

First, the first TFT M31 has one source/drain electrode connected to the pixel electrode A31 and the other source/drain electrode connected to the signal line Dm. The gate electrode of the first TFT M31 is connected to one source/drain electrode of the second TFT M32.

Next, the second TFT M32 has the other source/drain electrode connected to the scanning line Gn+3 and one source/drain electrode connected to the gate electrode of the first TFT M31. Accordingly, the gate electrode of the first TFT M31 is connected to the scanning line Gn+3 through the second TFT M32. Furthermore, the gate electrode of the second TFT M32 is connected to the scanning line Gn+1. Therefore, the first TFT M31 is turned on and the potential of the signal line Dm is supplied to the pixel electrode A31 for only a period when the potentials of the two scanning lines Gn+1 and Gn+3 are equal to the selection potential. This implies that the second TFT M32 is a switching element for controlling the turning ON/OFF of the first TFT M31.

The third TFT M33 has one source/drain electrode connected to the signal line Dm and the other source/drain electrode connected to the pixel electrode C31. The gate electrode of the third TFT M33 is connected to the scanning line Gn+1.

The fourth TFT M34 has one source/drain electrode connected to the signal line Dm and the other source/drain electrode connected to the pixel electrode B31. In addition, the gate electrode of the fourth TFT M34 is connected to one source/drain electrode of the fifth TFT M35.

Next, the fifth TFT M35 has the other source/drain electrode connected to the scanning line Gn+2 and one source/drain electrode connected to the gate electrode of the fourth TFT M34. Accordingly, the gate electrode of the fourth TFT M34 is connected to the scanning line Gn+2 through the fifth TFT M35. Furthermore, the gate electrode of the fifth TFT M35 is connected to the scanning line Gn+1. Consequently, only for a period when the potentials of the two scanning lines Gn+1 and Gn+2 are simultaneously equal to the selection potential, the fourth TFT M34 is turned on and the potential of the signal line Dm is supplied to the pixel electrode B31. This implies that the fifth TFT M35 is a switching element for controlling the turning ON/OFF of the fourth TFT M34.

In the above descriptions, the circuit construction of the array substrate A was described in consideration of the arrangement of the first to fifth TFTs M31 to M35. Next, the circuit construction of the array substrate A will be described in consideration of the pixel electrodes A31 to C31.

A display signal is supplied from the single signal line Dm to the pixel electrodes A31 to C31. Accordingly, the signal line Dm is a signal line Dm common to the pixel electrodes A31 to C31.

The first and second TFTs M31 and M32 are connected to the pixel electrode A31, and the first TFT M31 is connected to the signal line Dm and the second TFT M32. The gate electrode of the second TFT M32 is connected to the scanning line Gn+1 for the pixel electrode A31, and the source/drain electrode of the second TFT M32 is connected to the scanning line Gn+3 at the rear stage of the pixel electrode A31. Herein, to supply the potential of the signal line Dm to the pixel electrode A31, the first TFT M31 needs to be turned on. The gate electrode of the first TFT M31 is connected to the source/drain electrode of the second TFT M32, and the gate electrode of the second TFT M32 is connected to the scanning line Gn+1 at the rear stage of the pixel electrodes A31 and the pixel electrode B31. The source/drain electrode of the second TFT M32 is connected to the scanning line Gn+3 at the rear stage of the scanning line Gn+1. Consequently, to allow the first TFT M31 to turn on, the second TFT M32 needs to be turned on and the scanning line Gn+3 needs to be selected. To allow the second TFT M32 to turn on, the potential of the scanning line Gn+1 must be equal to the selection potential. Thus, the pixel electrode A31 is driven based on the scanning signal from the scanning line Gn+1 and the scanning signal from the scanning line Gn+3, and receives the potential from the signal line Dm.

The fourth and fifth TFTs M34 and M35 are connected to the pixel electrode B31, and the fourth TFT M34 is connected to the signal line Dm and the fifth TFT M35. The gate electrode of the fifth TFT M35 is connected to the scanning line Gn+1, and the source/drain electrode of the fifth TFT M35 is connected to the scanning line Gn+2. Herein, to supply the potential of the signal line Dm to the pixel electrode B31, the fourth TFT M34 needs to be turned on. The gate electrode of the fourth TFT M34 is connected to the source/drain electrode of the fifth TFT M35, and the gate electrode of the fifth TFT M35 is connected to the scanning line Gn+1. The source/drain electrode of the fifth TFT M35 is connected to the scanning line Gn+2. Accordingly, to allow the fourth TFT M34 to turn on, the fifth TFT M35 needs to be turned on and the scanning line Gn+2 needs to be selected. To allow the fifth TFT M35 to turn on, the potential of the scanning line Gn+1 needs to be equal to the selection potential. Thus, the potential from the signal line Dm is supplied to the pixel electrode B31 only when the potential of the scanning line Gn+1 positioned at the rear stage of the pixel electrode B31 and the potential of the scanning line Gn+2 at the rear stage of the scanning line Gn+1 become equal to the selection potential.

The third TFT M33 is connected to the pixel electrode C31 and the gate electrode of the third TFT M33 is connected to the scanning line Gn+1. Accordingly, the potential from the signal line Dm is supplied to the pixel electrode C31 when the scanning line Gn+1 is selected.

Descriptions of the pixel electrodes A31 to C31 were made in the above. The pixel electrodes D31 to F31, the pixel electrodes G31 to 131 and other pixels have the same construction as the pixel electrodes A31 to C31.

Next, operations of the pixel electrodes A31 to C31 depending on selections and non-selections of the scanning lines Gn+1 to Gn+3 will be described with reference to the circuit diagrams shown in FIGS. 11 to 13 and the timing charts of the scanning signals shown in FIG. 14. Note that illustration styles of the circuit diagrams in FIGS. 11 to 13 and that of the timing charts in FIG. 14 are the same as those of FIGS. 3 to 6 and FIG. 7 described in the first embodiment.

Figure 11:
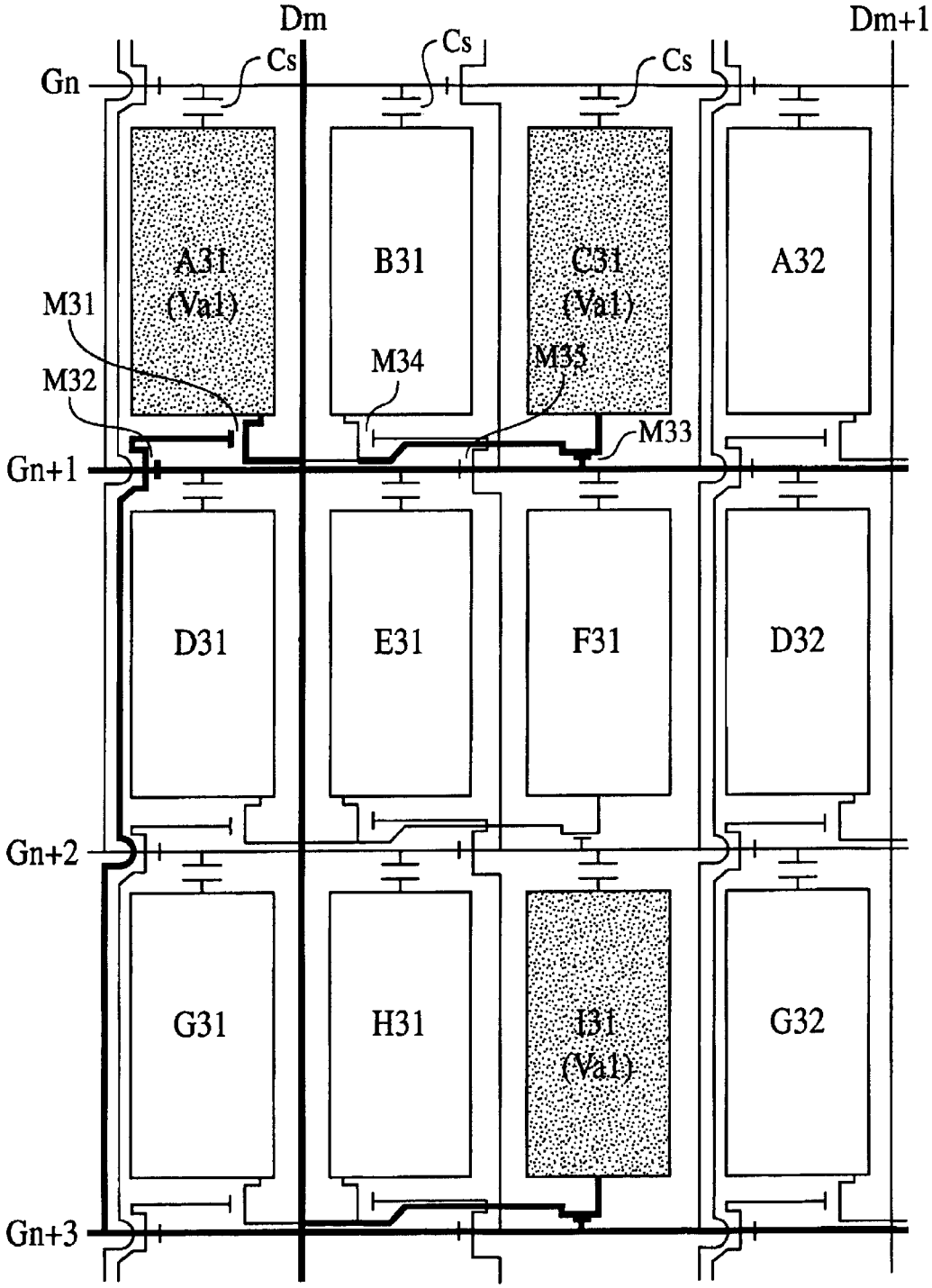
FIG. 11 is a drawing showing an operation of the array substrate A of the liquid crystal display apparatus of the fourth embodiment according to the present invention.
Figure 14:
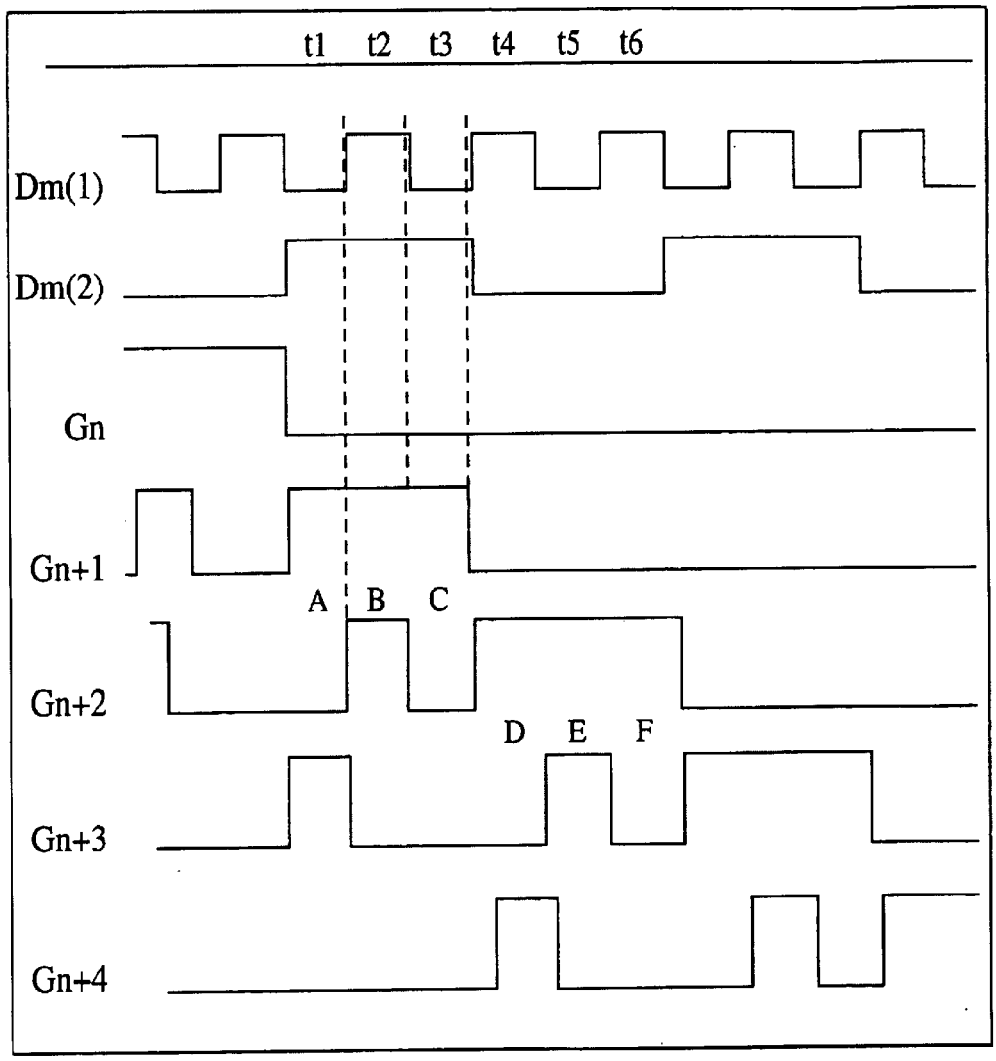
FIG. 14 is a drawing showing a timing chart of a scanning signal of the liquid crystal display apparatus of the fourth embodiment according to the present invention.

As shown in FIG. 11 and FIG. 14, the first to third TFTs M31 to M33 are turned on for a period (t1) from the time when both of the scanning lines Gn+1 and Gn+3 are selected to the time when the scanning line Gn+3 is non-selected. Accordingly, the potential Va1 to be given from the signal line Dm to the pixel electrode A31 is supplied to the pixel electrodes A31, C31 and 131 as shown in FIG. 11. Herein, the potential Va1 of the pixel electrode A31 is determined.

After the potential of the scanning line Gn+3 becomes equal to the non-selection potential, the potential supplied from the signal line Dm changes to the potential Vb1 to be given to the pixel electrode B31.

Figure 12:
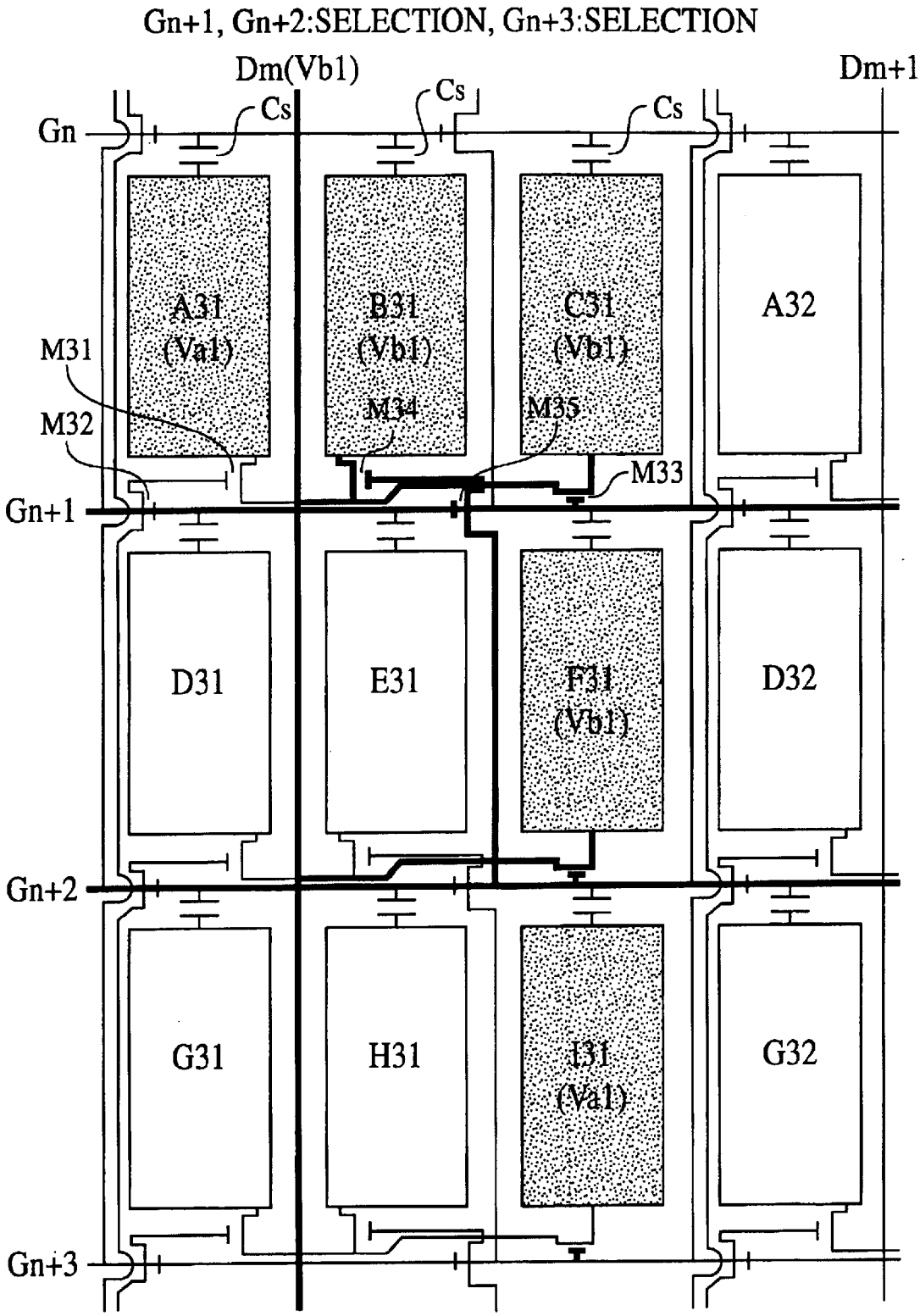
FIG. 12 is a drawing showing an operation of the array substrate A of the liquid crystal display apparatus of the fourth embodiment according to the present invention.

As shown in FIGS. 12 and 14, the second TFT M32 is turned on for a period (t2) from the time when the potential of the scanning line Gn+3 becomes equal to the non-selection potential to the time when the scanning lines Gn+1 and Gn+2 are selected. The first TFT M31 is turned off by supplying the potential (OFF potential) of the scanning line Gn+3 to the gate electrode of the first TFT M31. And the third TFT M33 to the fifth TFT M35 are turned on. Accordingly, the potential Vb1 is applied to the pixel electrodes B31, C31 and F31. Herein, the potential of the pixel electrode B31 is determined.

Next, after the potential of the scanning line Gn+2 becomes equal to the non-selection potential, the potential supplied from the signal line Dm changes to the potential Vc1 to be given to the pixel electrode C31.

Figure 13:
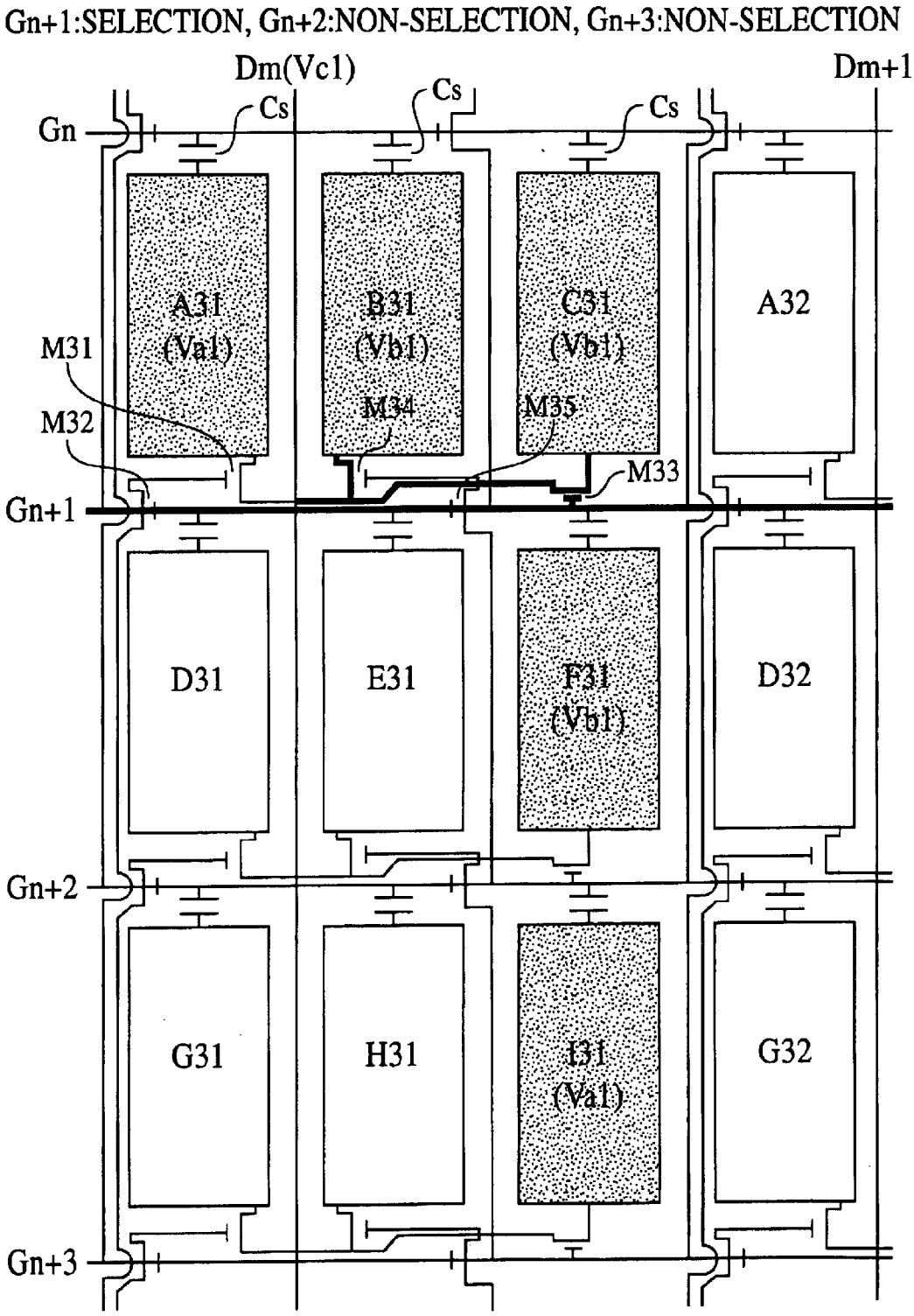
FIG. 13 is a drawing showing an operation of the array substrate A of the liquid crystal display apparatus of the fourth embodiment according to the present invention.

As shown in FIGS. 13 and 14, the potential of the signal line Dm is given to the pixel electrode C31 through the third TFT M33 for a period (t3) from the time when the potential of the scanning line Gn+2 becomes equal to the non-selection potential and the potential of the scanning line Gn+1 is equal to the selection potential to the time when the scanning line Gn+1 becomes equal to the non-selection potential. Thus, the potential of the pixel electrode C31 is determined.

Next, also after the potential of the scanning line Gn+1 becomes equal to the non-selection potential, the potential of the signal line Dm changes to the potential Vd1 to be given to the pixel electrode D31, and the potentials of the pixel electrodes D31 to F31 are determined time-divisionally in the same manner as the above.

The liquid crystal display apparatus according to the fourth embodiment adopts the structure in which the data potential is supplied from one signal line, for example, the signal line Dm, to the three pixel electrodes A31 to C31. Consequently, compared to the conventional liquid crystal display apparatus in which the pixel and the signal line correspond to each other with a one-to-one correspondence relation, the number of the signal lines, that is, the number of the data drivers, can be reduced to one-third.

Furthermore, the first TFT M31 connected to the pixel electrode A31, the fourth TFT M34 connected to the pixel electrode B31 and the third TFT M33 connected to the pixel electrode C31 are directly connected to the common signal line Dm. Therefore, the liquid crystal display apparatus of the fourth embodiment contributes to a realization of a liquid crystal display panel having a high aperture ratio similarly to that of the first embodiment. Moreover, since the storage capacitor Cs is provided between the pixel electrode and the scanning line at the front stage of that pixel electrode also in the fourth embodiment, it is possible to control the pixel potential with a high precision, resulting in provision of a high quality image.

A liquid crystal display apparatus of a fifth embodiment of the present invention will be described below.

While the storage capacitor Cs is formed by the use of the scanning line in the first to fourth embodiments, the fifth embodiment provides a circuit construction suitable for formation of an independent capacitor electrode.

Figure 15:
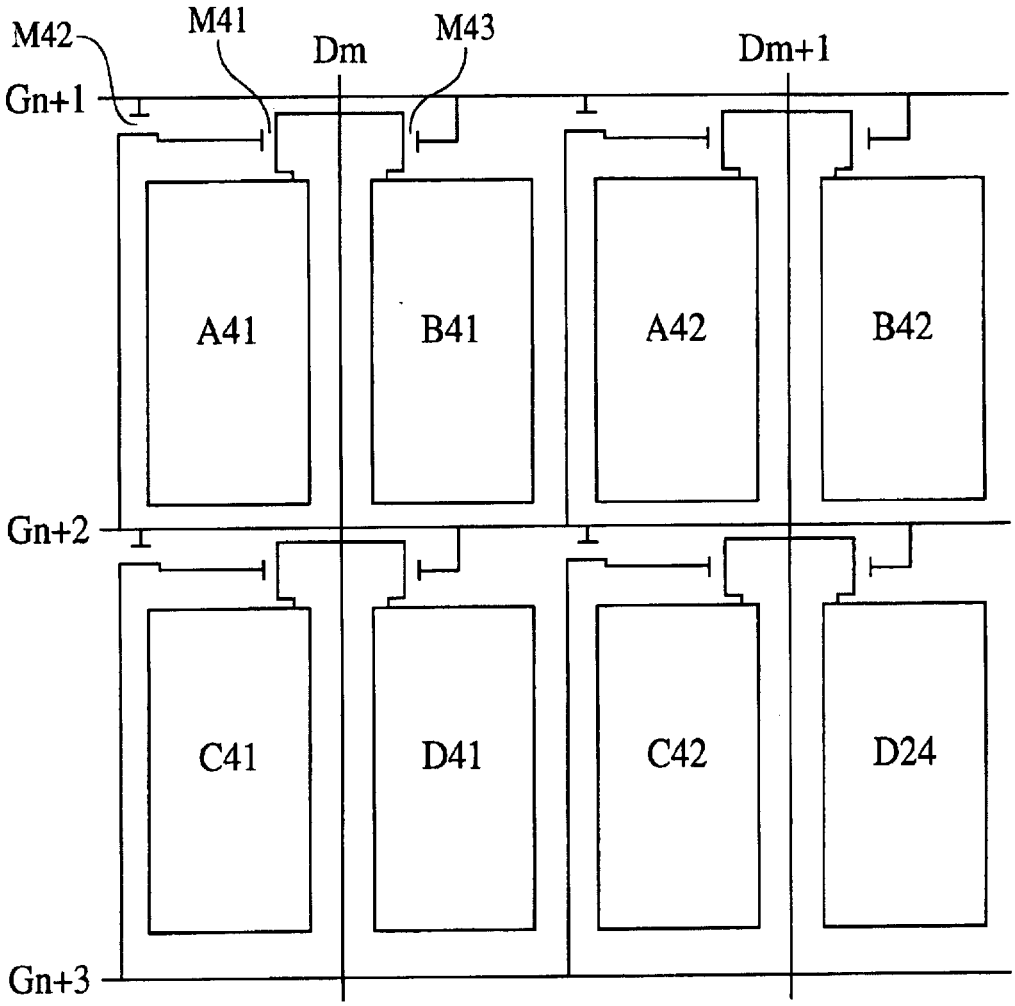
FIG. 15 is a drawing showing the construction of an array substrate A of a liquid crystal display apparatus of a fifth embodiment according to the present invention.

The construction of the array substrate A of the liquid crystal display apparatus according to the fifth embodiment is shown in FIG. 15.

In the fifth embodiment, the two pixels that are the pixel electrode A41 (pixel electrode C41, . . . ) and the pixel electrode B41 (pixel electrode D41, . . . ) share the signal line Dm. When the potentials of both of the scanning lines Gn+1 and Gn+2 become equal to the selection potential, the data potential of the signal line Dm is supplied to the pixel electrode A41. When the potential of the scanning line Gn+1 becomes equal to the selection potential, the data potential of the signal line Dm is supplied to the pixel electrode B41.

To perform the above-described operations, arrangements of the first to third TFTs M41 to M43 as a switching element are set as follows in the fifth embodiment.

First, the first TFT M41 has one source/drain electrode connected to the pixel electrode A41, and the other source/drain electrode connected to the signal line Dm. The gate electrode of the first TFT M41 is connected to one source/drain electrode of the second TFT M42.

Next, the second TFT M42 has one source/drain electrode connected to the scanning line Gn+2 and the other source/drain electrode connected to the gate of the first TFT M41. Accordingly, the gate electrode of the first TFT M41 is connected to the scanning line Gn+2 through the second TFT M42. Furthermore, the gate electrode of the second TFT M42 is connected to the scanning line Gn+1. Consequently, only for a period when the two scanning lines Gn+1 and Gn+2 are simultaneously equal to the selection potential, the first TFT M41 is turned on, and the potential of the signal line Dm is supplied to the pixel electrode A41. This implies that the first TFT M41 is a switching element which is turned on/off in conjunction with the turning ON/OFF of the second TFT M42.

The third TFT M43 has one source/drain electrode connected to the signal line Dm and the other source/drain electrode connected to the pixel electrode B41. Furthermore, the gate electrode of the third TFT M43 is connected to the scanning line Gn+1. Accordingly, when the potential of the scanning line Gn+1 is equal to the selection potential, the third TFT M43 is turned on, and the potential of the signal line Dm is supplied to the pixel electrode B41.

In the above descriptions, the circuit construction of the array substrate A was described in consideration of the arrangement of the first to third TFTs M41 to M43. Next, the circuit construction of the array substrate A will be described in consideration of the pixel electrodes A41 and B41. Note that an illustration of the storage capacitor is omitted.

The display signal is supplied from the single signal line Dm to the pixel electrodes A41 and B41. Accordingly, it can be said that the signal line Dm is a signal line Dm common to the pixel electrodes A41 and B41.

The first and second TFTs M41 and M42 are connected to the pixel electrode A41, and the first TFT M41 is connected to the signal line Dm and to the second TFT M42. The gate electrode of the second TFT M42 is connected to the scanning line Gn+1 at the front stage of the pixel electrodes A41 and B41. Moreover, the source/drain electrode of the second TFT M42 is connected to the scanning line Gn+2 at the rear stage of the pixel electrodes A41 and B41. Herein, to supply the potential of the signal line Dm to the pixel electrode A41, the first TFT M41 needs to be turned on. The gate electrode of the first TFT M41 is connected to the source/drain electrode of the second TFT M42, and the gate electrode of the second TFT M42 is connected to the scanning line Gn+1. The source/drain electrode of the second TFT M42 is connected to the scanning line Gn+2. Therefore, to allow the first TFT M41 to turn on, the second TFT M42 needs to be turned on and the scanning line Gn+2 needs to be selected. To allow the second TFT M42 to turn on, the potential of the scanning line Gn+1 needs to be equal to the selection potential. Thus, the potential from the signal line Dm is supplied to the pixel electrode A41 only when the potential of the scanning line Gn+1 at the front stage of the pixel electrode A41 and the potential of the scanning line Gn+2 at the rear stage of the pixel electrode A41 become equal to the selection potential.

The third TFT M43 is connected to the pixel electrode B41, and the gate electrode of the third TFT M43 is connected to the scanning line Gn+1. Accordingly, when the scanning line Gn+1 is selected, the potential is supplied from the signal line Dm to the pixel electrode A42.

In the above, the descriptions were made as to the pixel electrodes A41 and B41. However, the pixel electrodes A42 and B42, the pixel electrodes C41 and D41, the pixel electrodes C42 and D42, and other pixel electrodes have the same construction.

Next, operations of the pixel electrodes A41 and B41 depending on selections and non-selections of the scanning lines Gn+1 to Gn+2 will be described with reference to the circuit diagrams shown in FIGS. 16 and 17 and the timing charts of the scanning signals shown in FIG. 18. Note that illustration styles of the circuit diagrams in FIGS. 16 and 17 and that of the timing charts in FIG. 18 are the same as those of FIGS. 3 to 6 and FIG. 7 described in the first embodiment.

Figure 16:
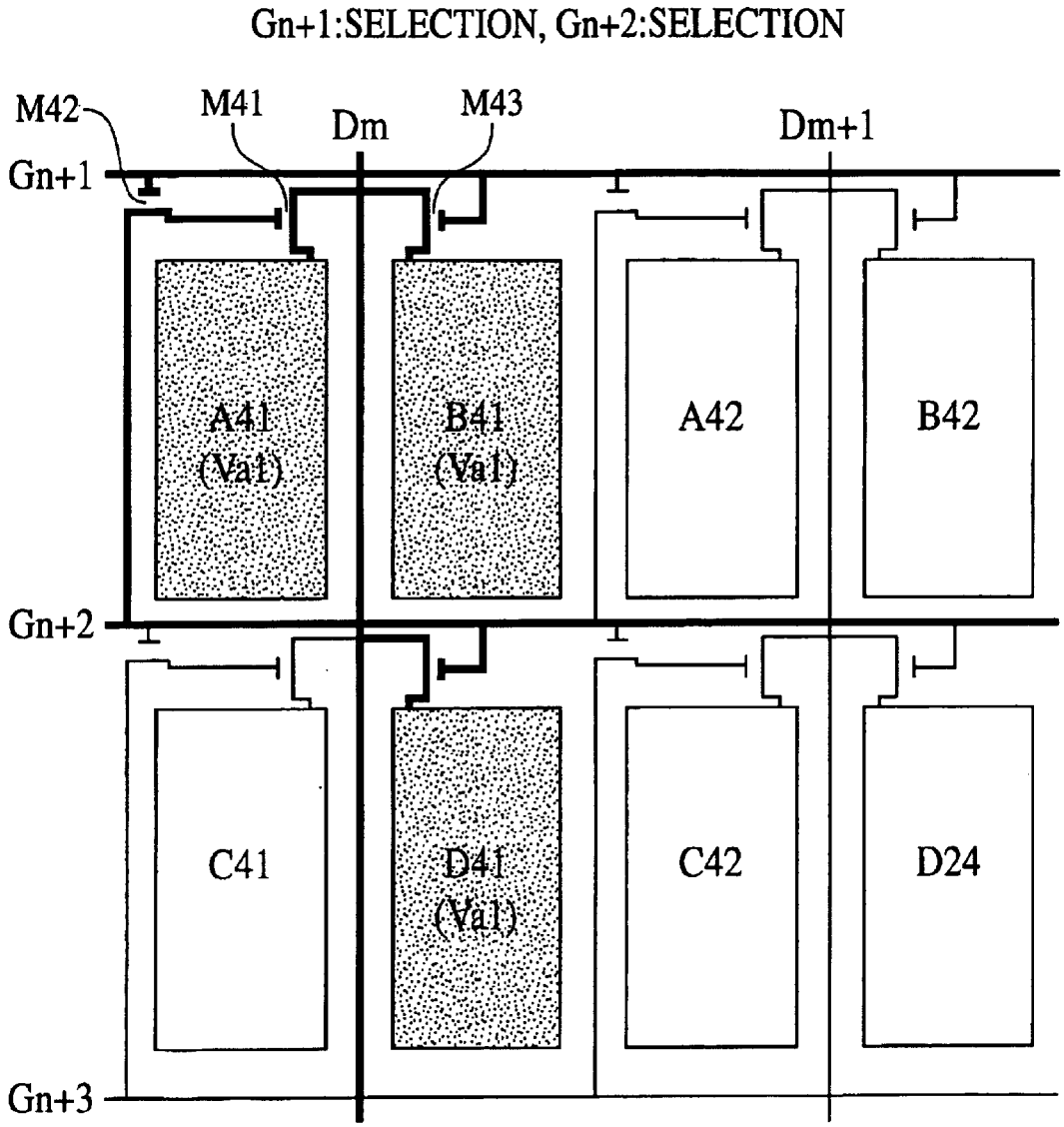
FIG. 16 is a drawing showing an operation of the array substrate A of the liquid crystal display apparatus of the fifth embodiment according to the present invention.
Figure 18:
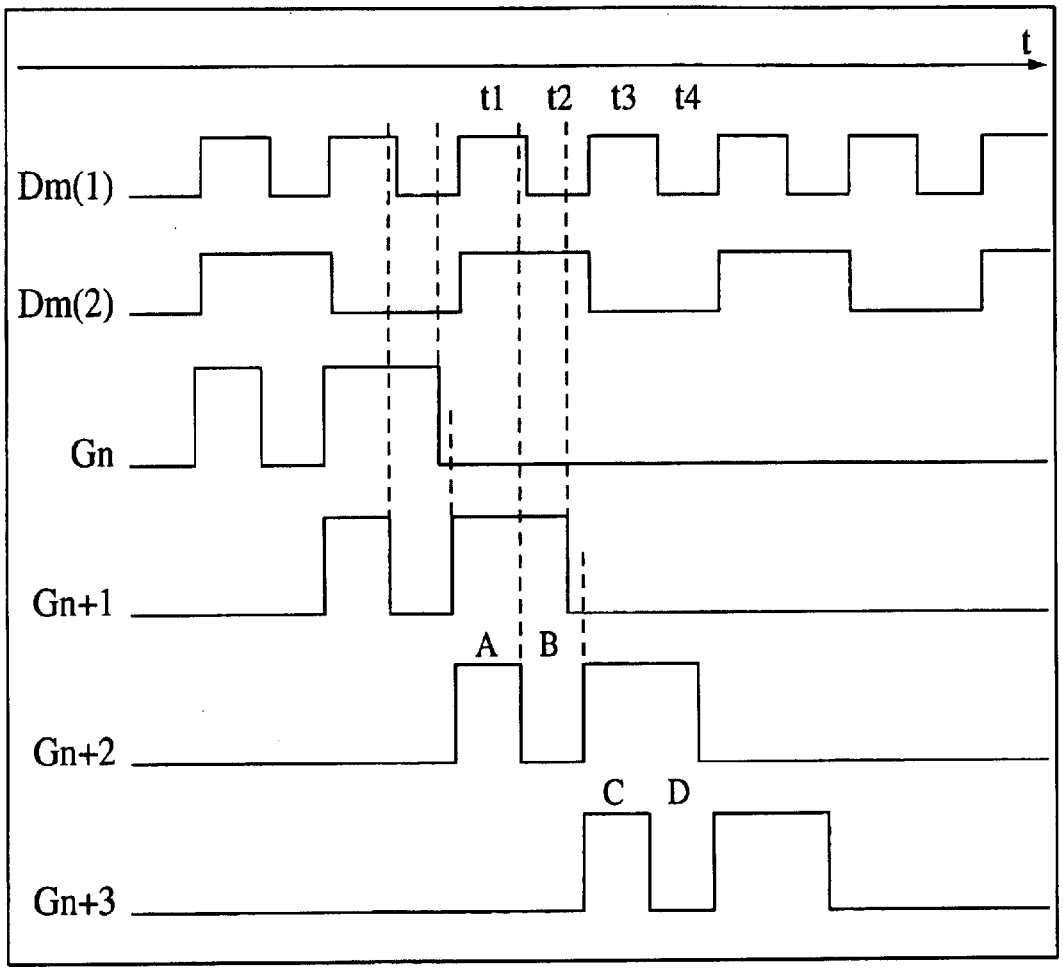
FIG. 18 is a drawing showing a timing chart of a scanning signal of the liquid crystal display apparatus of the fifth embodiment according to the present invention.

As shown in FIG. 16 and 18, the first to third TFTs M41 to M43 are turned on for a period (t1) from the time when the potentials of both of the scanning lines Gn+1 and Gn+2 become equal to the selection potential to the time when the scanning line Gn+2 becomes equal to the non-selection potential. Accordingly, the potential Va1 to be given to the pixel electrode A41 from the signal line Dm is supplied to the pixel electrodes A41, B41 and D41, as shown in FIG. 16. Herein, the potential Va1 of the pixel electrode A41 is determined.

After the potential of the scanning line Gn+2 becomes equal to the non-selection potential, the potential supplied from the signal line Dm changes to the potential Vb1 to be given to the pixel electrode B41.

Figure 17:
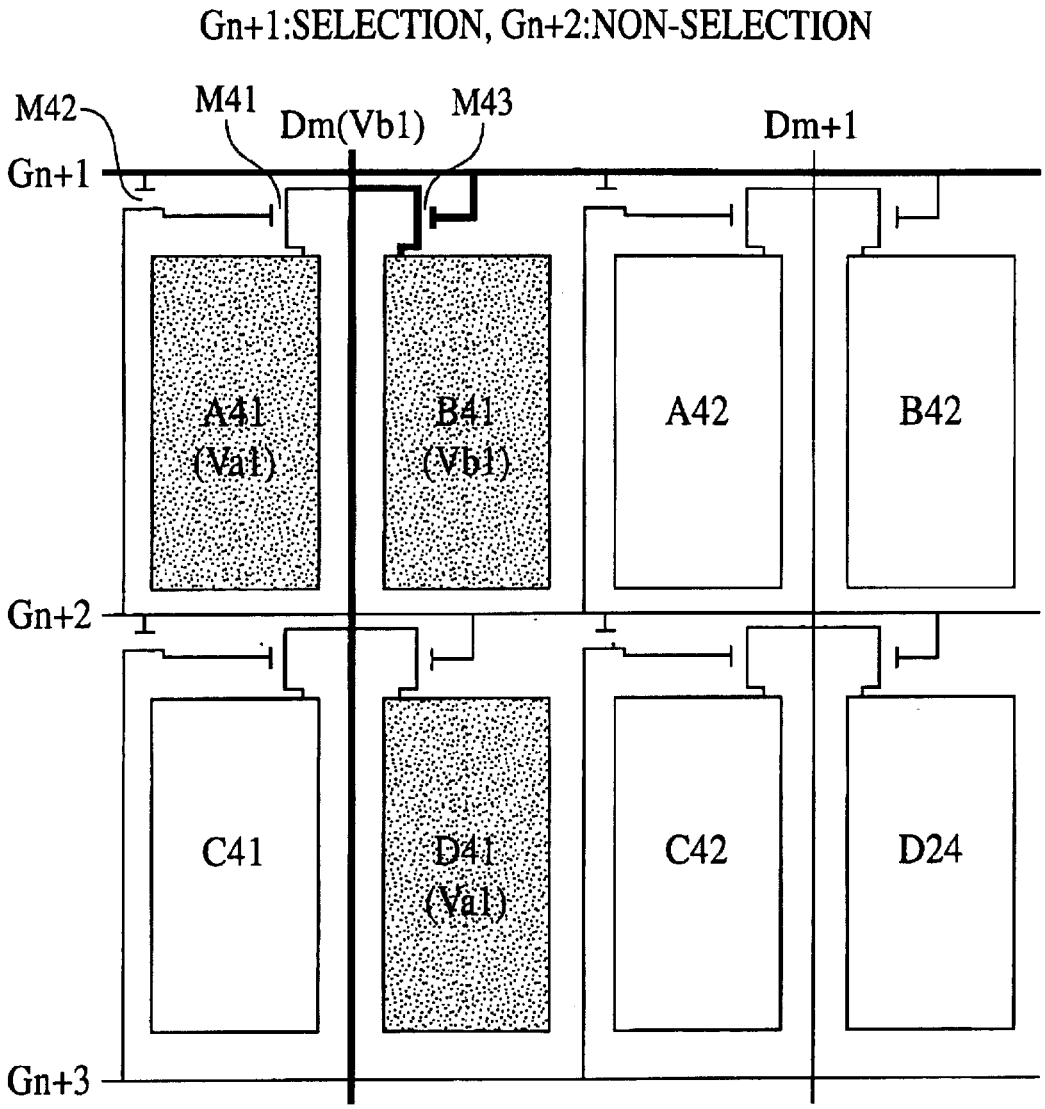
FIG. 17 is a drawing showing an operation of the array substrate A of the liquid crystal display apparatus of the fifth embodiment according to the present invention.

Next, as shown in FIG. 18, by keeping the scanning line Gn+1 at the selection potential also for a period (t2) from the time when the potential of the scanning line Gn+2 becomes equal to the non-selection potential, the potential Vb1 is continuously supplied to the pixel electrode B41 as shown in FIG. 17, and the potential of the pixel electrode B41 is determined.

Subsequently, the potential supplied from the signal line Dm changes to the potential Vc1 to be given to the pixel electrode C41 also after the potential of the scanning line Gn+1 becomes equal to the non-selection potential. The potentials of the pixel electrodes C41 and D41 are determined time-divisionally in the same manner as the above.

Also in the fifth embodiment, the construction is adopted, in which a driving potential is supplied from one signal line, for example, the signal line Dm to the two pixel electrodes A41 and B41 adjacent to each other so as to interpose this signal line. Accordingly, compared to the conventional liquid crystal display apparatus in which the pixel and the signal line correspond to each other with a one-to-one correspondence relation, the number of the signal lines, that is, the number of the data drivers, can be halved.

Furthermore, in the fifth embodiment, the storage capacitor using the scanning line is not formed, but an independent capacitor electrode can be formed. The independent storage capacitor has an advantage that a time constant of the gate line is small and an unstable factor is reduced compared to the storage capacitor using the scanning line.

A liquid crystal display apparatus of the sixth embodiment of the present invention will be described below.

In the liquid crystal display apparatus of the first embodiment, the numbers of the TFTs connected to the adjacent pixels are different. For example, the two TFTs are connected to the pixel electrode A1, and one TFT is connected to the pixel electrode B1. The sixth embodiment aims at equalizing the number of the TFTs connected to the pixel electrodes.

Figure 19:
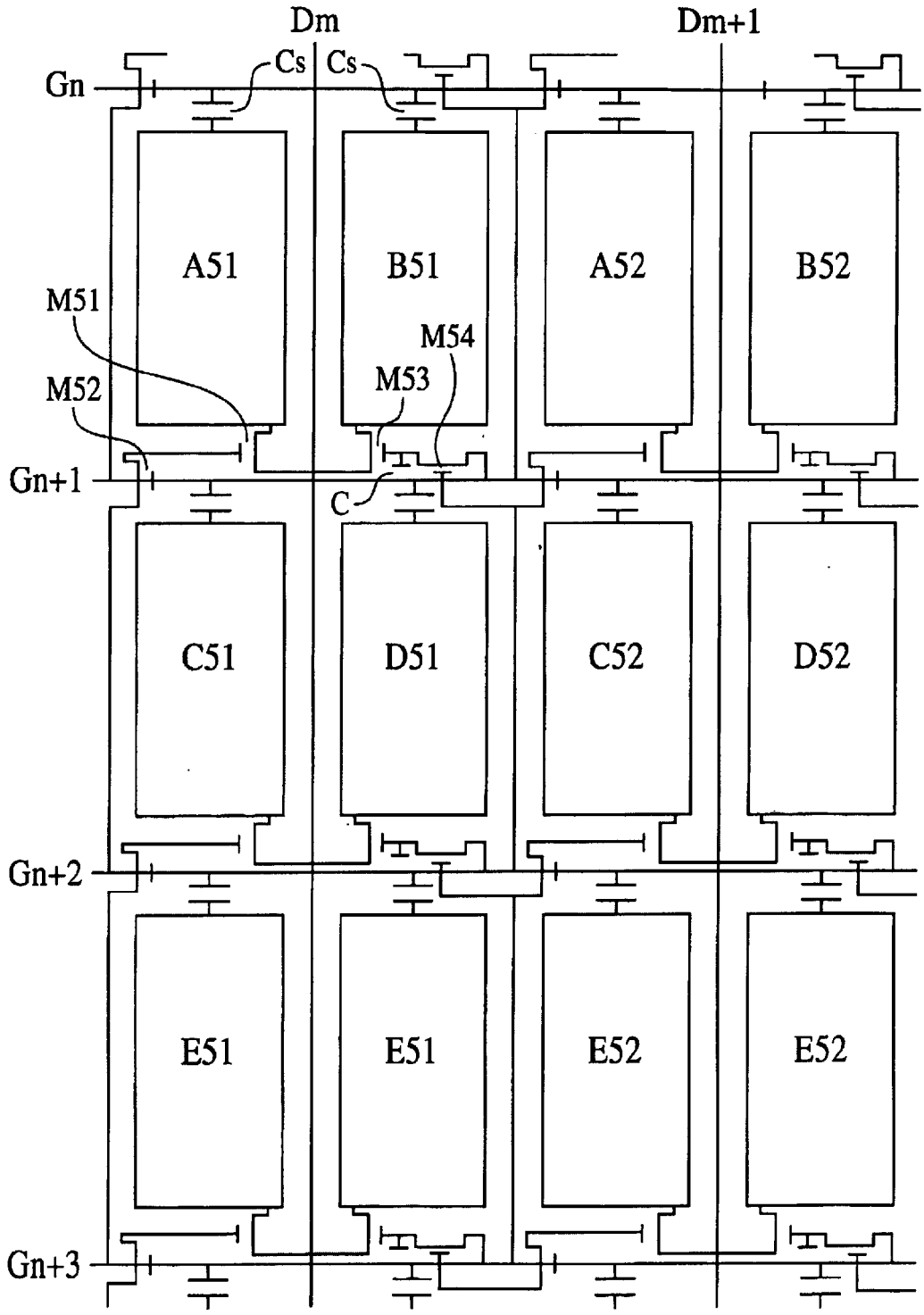
FIG. 19 is a drawing showing the construction of an array substrate A of a liquid crystal display apparatus of a sixth embodiment according to the present invention.

The construction of the array substrate A of the liquid crystal display apparatus according to the sixth embodiment is shown in FIG. 19.

In the sixth embodiment, the two pixels that are the pixel electrode A51 (pixel electrode C51, . . . ) and the pixel electrode B51 (pixel electrode D51, . . . ) share the signal line Dm. The data potential of the signal line Dm is supplied to the pixel electrode A51 when the potentials of both of the scanning lines Gn+1 and Gn+2 become equal to the selection potential. The data potential of the signal line Dm is supplied to the pixel electrode B51 for a period from the time when the potential of the scanning line Gn+2 becomes equal to the non-selection potential to the time when the potential of the scanning line Gn+2 becomes again equal to the selection potential.

To perform the above-described operations, arrangements of the first to fourth TFTs M51 to M54 as a switching element are set as follows in the sixth embodiment.

First, the first TFT M51 has one source/drain electrode connected to the pixel electrode A51, and the other source/drain electrode connected to the signal line Dm. The gate electrode of the first TFT M51 is connected to one source/drain electrode of the second TFT M52.

Next, the second TFT M52 has one source/drain electrode connected to the gate of the first TFT M51 and the other source/drain electrode connected to the scanning line Gn+2. Accordingly, the gate electrode of the first TFT M51 is connected to the scanning line Gn+2 through the second TFT M52. Furthermore, the gate electrode of the second TFT M52 is connected to the scanning line Gn+1. Consequently, only for a period when the two scanning lines Gn+1 and Gn+2 are simultaneously equal to the selection potential, the first TFT M51 is turned on, and the potential of the signal line Dm is supplied to the pixel electrode A51. This implies that the first TFT M51 is a switching element which is turned on/off in conjunction with the turning ON/OFF of the second TFT M52.

The third TFT M53 has one source/drain electrode connected to the signal line Dm, and the other source/drain electrode connected to the pixel electrode B51. Furthermore, the gate electrode of the third TFT M53 is connected to one source/drain electrode of the fourth TFT 54. Furthermore, the charge capacitor C is connected to the gate electrode of the third TFT M53. This charge capacitor C has capacitance enough to hold charges given to the gate electrode of the third TFT M53.

The fourth TFT M54 has one source/drain electrode connected to the gate electrode of the third TFT M53 and the other source/drain electrode connected to the scanning line Gn+1. Furthermore, the gate electrode of the fourth TFT M54 is connected to the scanning line Gn+2. Accordingly, the gate electrode of the third TFT M53 is connected to the scanning line Gn+1 through the fourth TFT M54.

In the above descriptions, the circuit construction of the array substrate A was described in consideration of the arrangement of the first to fourth TFTs M51 to M54. Next, the circuit construction of the array substrate A will be described in consideration of the pixel electrodes A51 and B51.

The display signal is supplied from the single signal line Dm to the pixel electrodes A51 and B51. Accordingly, it can be said that the signal line Dm is a signal line common to the pixel electrodes A51 and B51.

The first and second TFTs M51 and M52 are connected to the pixel electrode A51, and the first TFT M51 is connected to the signal line Dm and to the second TFT M52. The gate electrode of the second TFT M52 is connected to the scanning line Gn+1 at the rear stage of the pixel electrodes A51, and the source/drain electrode of the second TFT M52 is connected to the scanning line Gn+2 at the rear stage of the scanning line Gn+1. Herein, to supply the potential of the signal line Dm to the pixel electrode A51, the first TFT M51 has to be turned on. The gate electrode of the first TFT M51 is connected to the source/drain electrode of the second TFT M52, and the gate electrode of the second TFT M52 is connected to the scanning line Gn+1. The source/drain electrode of the second TFT M52 is connected to the scanning line Gn+2. Therefore, to allow the first TFT M51 to turn on, the second TFT M52 has to be turned on and the scanning line Gn+2 needs to be selected. To allow the second TFT M52 to turn on, the potential of the scanning line Gn+1 must be equal to the selection potential. Thus, the potential from the signal line Dm is supplied to the pixel electrode A51 only when the potentials of the scanning lines Gn+1 and Gn+2 become equal to the selection potential.

The third and fourth TFTs M53 and M54 are connected to the pixel electrode B51, and the third TFT M53 is connected to the signal line Dm and to the fourth TFT M54. One source/drain electrode of the fourth TFT M54 is connected to the gate electrode of the third TFT M53, and the other source/drain electrode of the fourth TFT M54 is connected to the scanning line Gn+1. The gate electrode of the fourth TFT M54 is connected to the scanning line Gn+2. The charge capacitor C enough to hold charges after the potential of the scanning line Gn+2 becomes equal to the non-selection potential is connected to the gate electrode of the third TFT M53. The charges are given to the gate electrode of the third TFT M53 when the pixel electrode A51 is selected. For this reason, as described later, the potential of the signal line Dm is supplied to the pixel electrode B51, for a period from the time when the potential of the scanning line Gn+2 becomes equal to the non-selection potential to the time when the potential of the scanning line Gn+2 becomes again equal to the selection potential and thus the charges of the gate electrode of the third TFT M53 move to turn off the third TFT M53.

In the above, the descriptions were made as to the pixel electrodes A51 and B51. The pixel electrodes A52 and B52, the pixel electrodes C51 and D51, the pixel electrodes C52 and D52, and other pixel electrodes have the same construction.

Next, operations of the pixel electrodes A51 to D51 depending on selections of the scanning lines Gn+1 to Gn+3 will be described with reference to the circuit diagrams shown in FIGS. 20 to 25 and the timing charts of the scanning signals shown in FIG. 26. Note that illustration styles of the circuit diagrams in FIGS. 20 to 25 and that of the timing charts in FIG. 26 are the same as those of FIGS. 3 to 6 and FIG. 7 described in the first embodiment.

Figure 20:
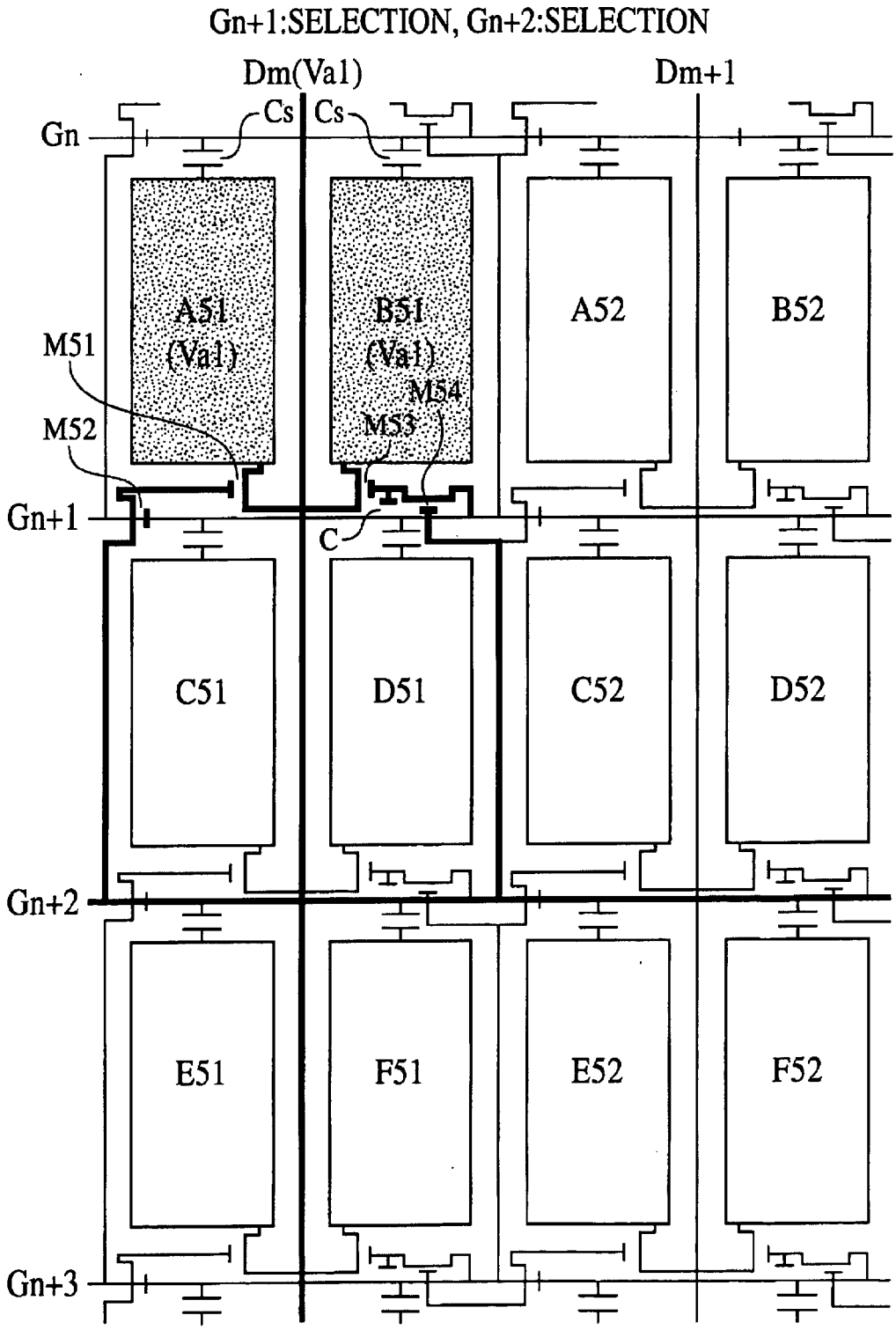
FIG. 20 is a drawing showing an operation of the array substrate A of the liquid crystal display apparatus of the sixth embodiment according to the present invention.
Figure 26:
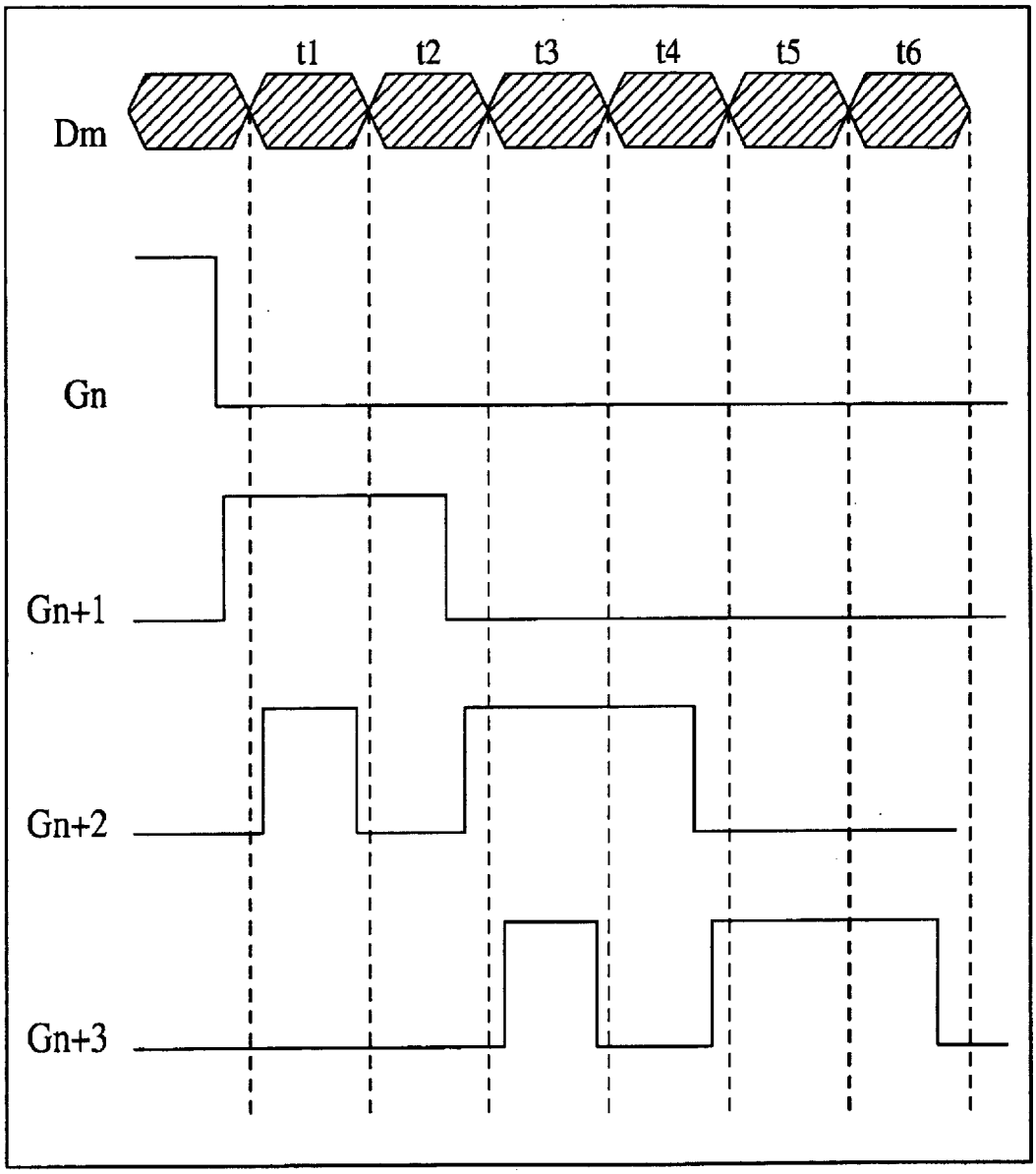
FIG. 26 is a drawing showing a timing chart of a scanning signal of the liquid crystal display apparatus of the sixth embodiment according to the present invention.
Figure 27:
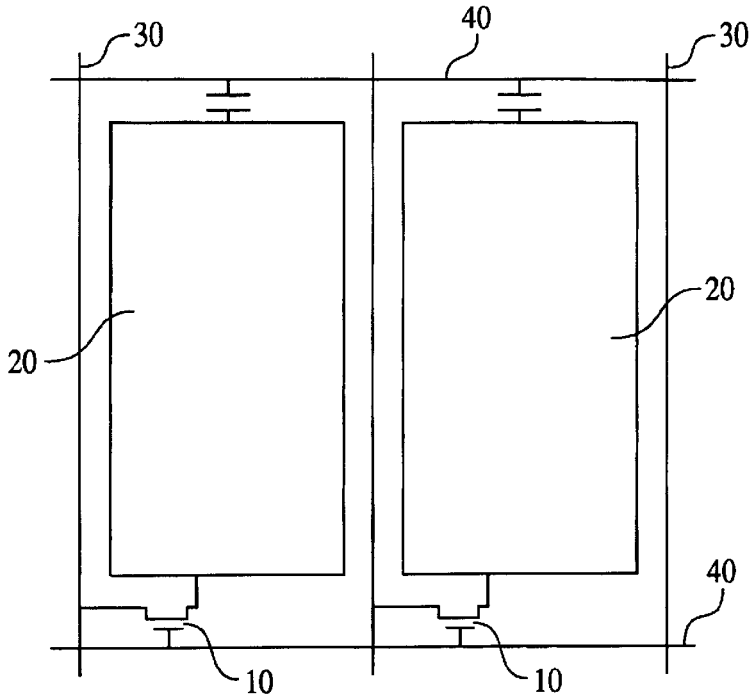
FIG. 27 (PRIOR ART)
FIG. 27 is an equivalent circuit diagram of a conventional TFT array substrate.

As shown in FIGS. 20 and 26, the first to fourth TFTs M51 to M54 are turned on for a period (t1) from the time when the potentials of both of the scanning lines Gn+1 and Gn+2 become equal to the selection potential to the time when the scanning line Gn+2 becomes equal to the non-selection potential. Accordingly, the potential Va1 to be given to the pixel electrode A51 from the signal line Dm is supplied to the pixel electrodes A51 and B51, as shown in FIG. 20. Herein, the potential Va1 of the pixel electrode A51 is determined.

After the potential of the scanning line Gn+2 becomes equal to the non-selection potential, the potential supplied from the signal line Dm changes to the potential Vb1 to be given to the pixel electrode B51.

Figure 21:
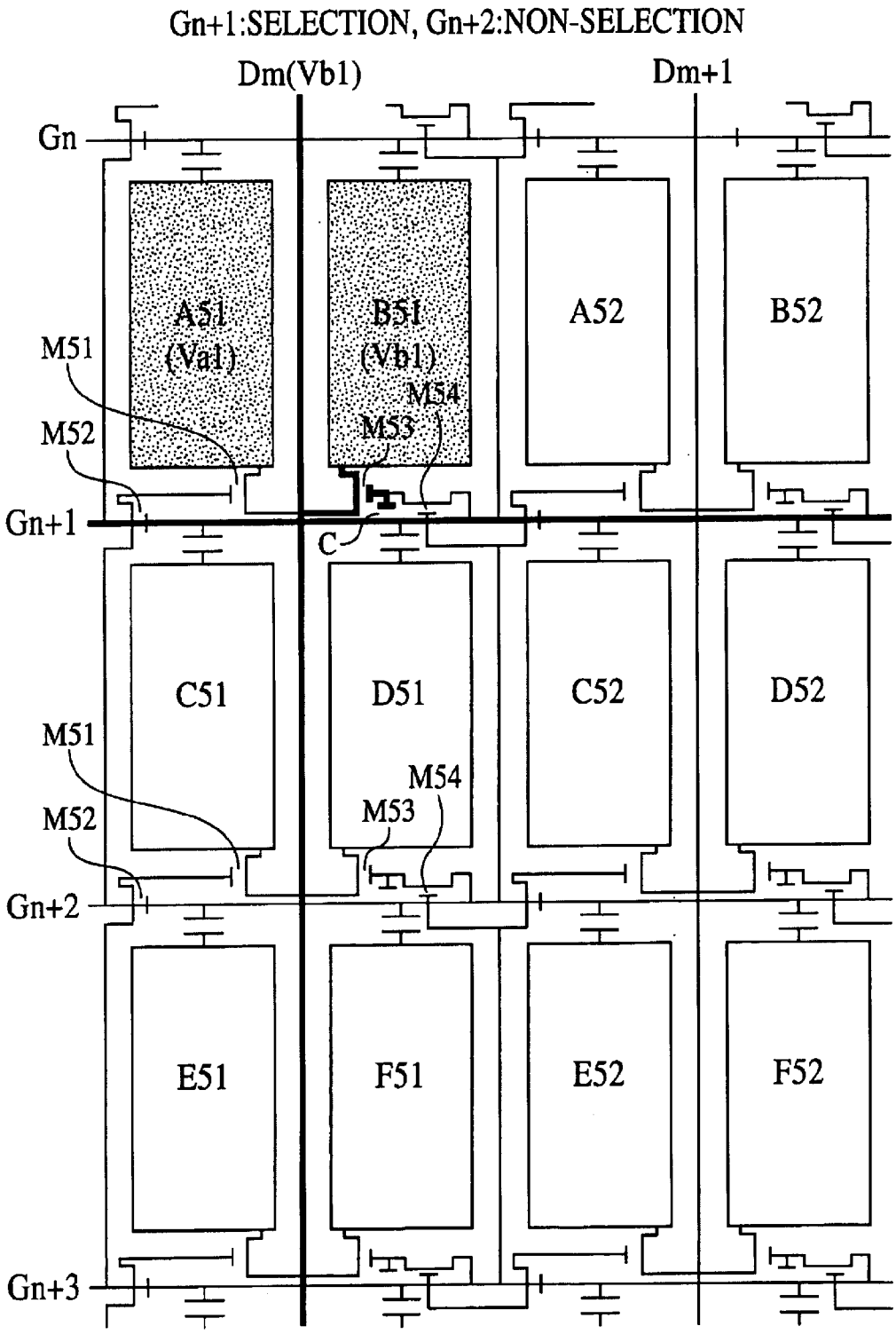
FIG. 21 is a drawing showing an operation of the array substrate A of the liquid crystal display apparatus of the sixth embodiment according to the present invention.
Figure 22:
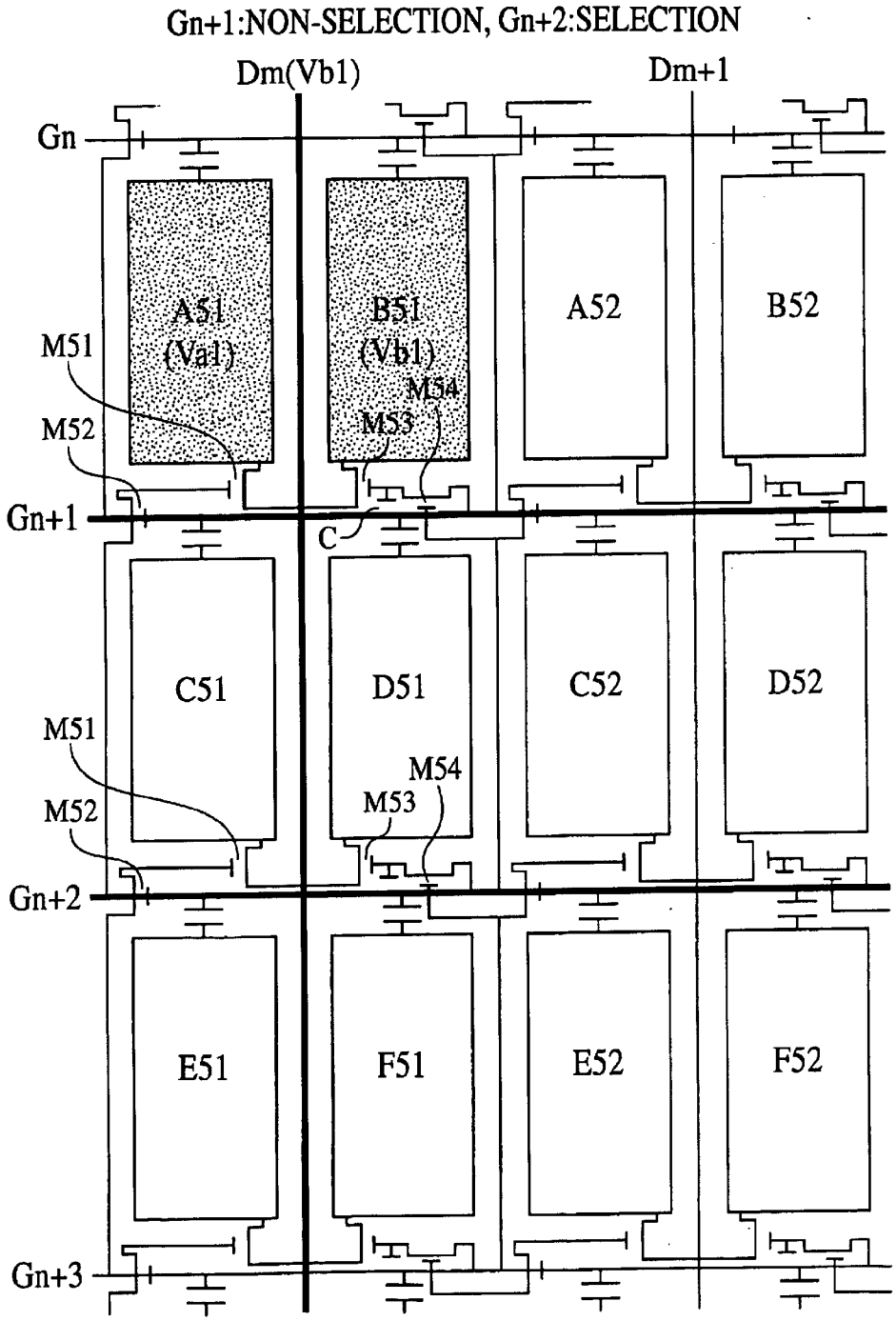
FIG. 22 is a drawing showing an operation of the array substrate A of the liquid crystal display apparatus of the sixth embodiment according to the present invention.

As shown in FIGS. 21 and 26, the third TFT M53 is kept at the selection potential by the existence of the charge capacitor C for a period (t2) after the potential of the scanning line Gn+2 becomes equal to the non-selection potential. Accordingly, the potential Vb1 is supplied to the pixel electrode B51. Thereafter, as shown in FIGS. 22 and 26, when the potential of the scanning line Gn+1 becomes equal to the non-selection potential and then the potential of the scanning line Gn+2 becomes again equal to the selection potential during the period t2, the third TFT M53 is cut off, and the potential Vb1 of the pixel electrode B51 is determined.

Figure 23:
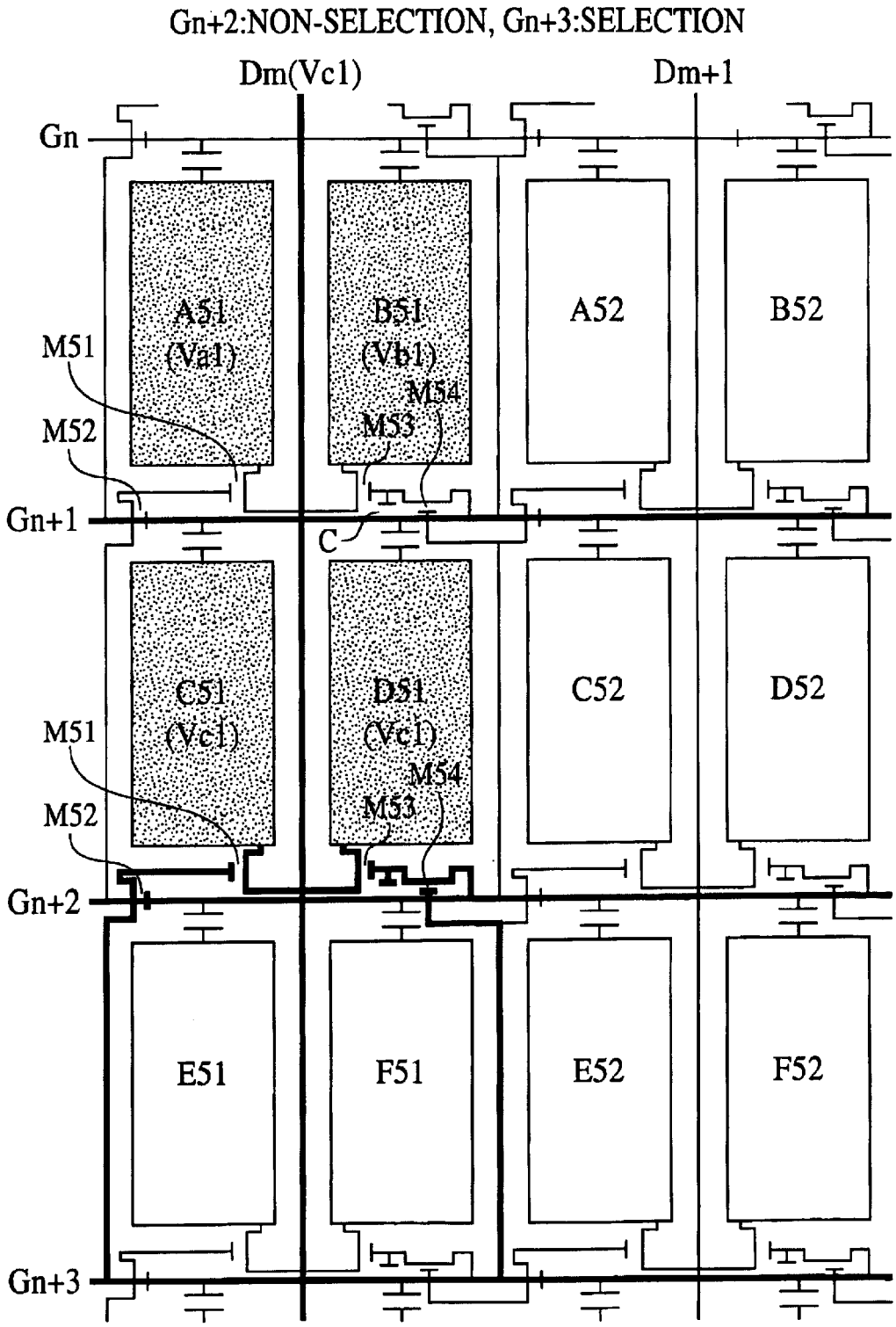
FIG. 23 is a drawing showing an operation of the array substrate A of the liquid crystal display apparatus of the sixth embodiment according to the present invention.

Next, as shown in FIGS. 23 and 26, the first to fourth TFTs M51 to M54 are turned on for a period (t3) from the time when both of the scanning lines Gn+2 and Gn+3 are selected to the time when the potential of the scanning line Gn+3 becomes equal to the non-selection potential. Accordingly, the potential Vc1 to be given from the signal line Dm to the pixel electrode C51 is supplied to the pixel electrodes C51 and D51 as shown in FIG. 23. Herein, the potential Vc1 of the pixel electrode C51 is determined.

The potential supplied from the signal line Dm changes to the potential Vd1 to be given to the pixel electrode D51 after the potential of the scanning line Gn+3 becomes equal to the non-selection potential.

Figure 24:
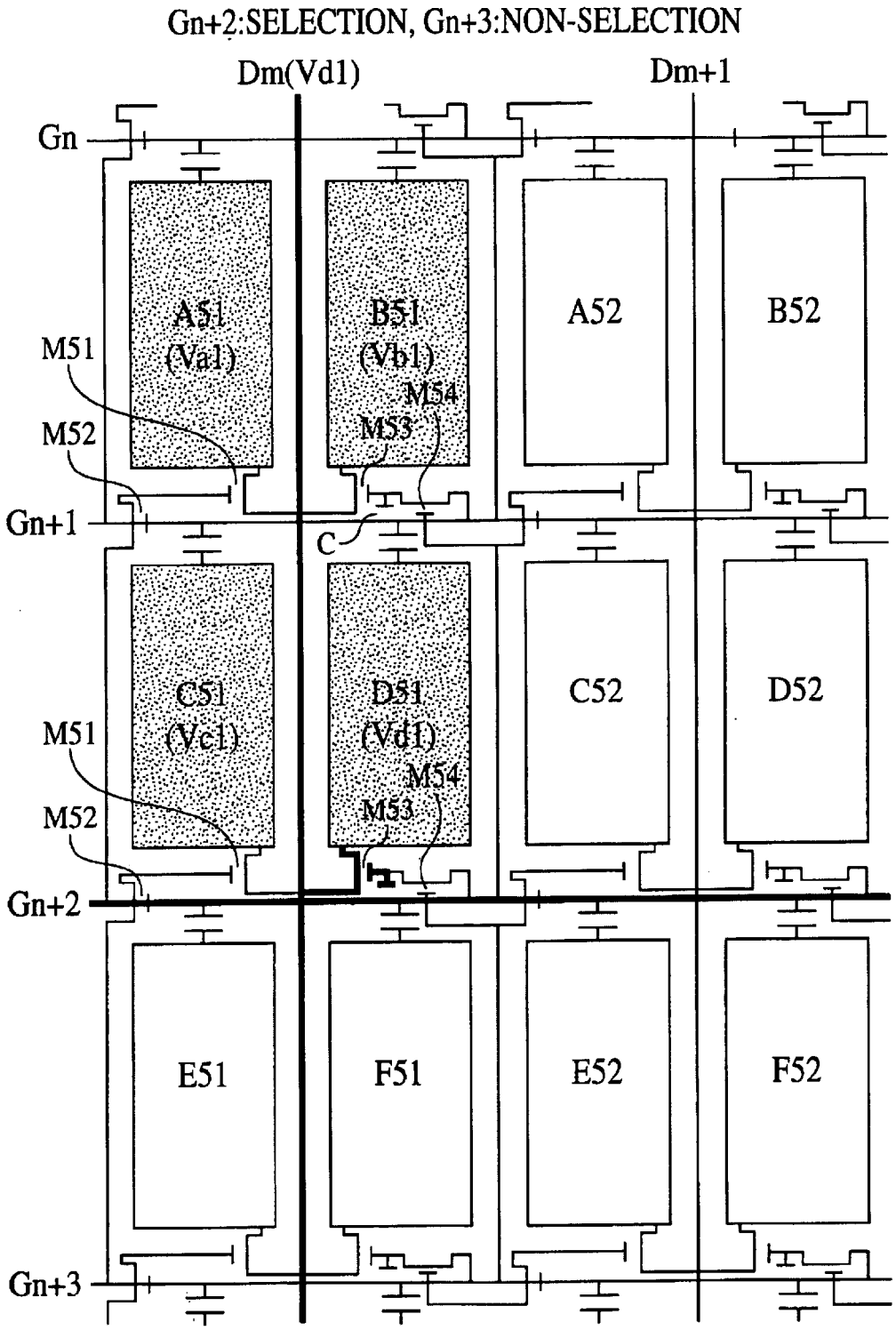
FIG. 24 is a drawing showing an operation of the array substrate A of the liquid crystal display apparatus of the sixth embodiment according to the present invention.
Figure 25:
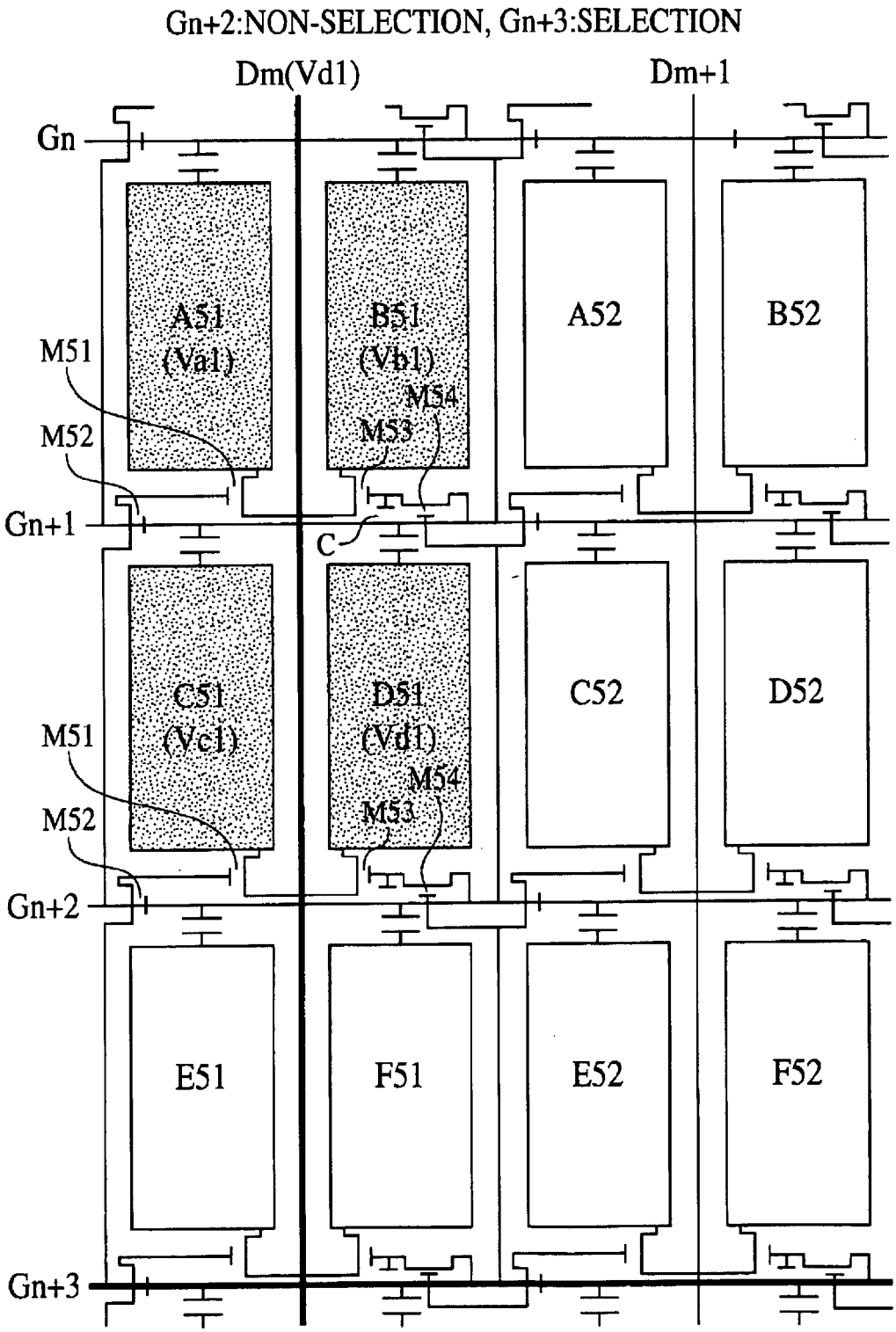
FIG. 25 is a drawing showing an operation of the array substrate A of the liquid crystal display apparatus of the sixth embodiment according to the present invention.

As shown in FIGS. 24 and 26, the third TFT M53 of the pixel electrode D51 is kept at the selection potential by the existence of the charge capacitor C for a period (t4) after the potential of the scanning line Gn+3 becomes equal to the non-selection potential. Accordingly, the potential Vd1 is supplied to the pixel electrode D51. Thereafter, as shown in FIGS. 25 and 26, when the potential of the scanning line Gn+2 becomes equal to the non-selection potential and then the potential of the scanning line Gn+3 becomes again equal to the selection potential during the period t4, the third TFT M53 of the pixel electrode D51 is cut off, and the potential Vd1 of the pixel electrode D51 is determined.

Thereafter, the potentials of the pixel electrodes E51, F51 and the like are sequentially determined in the same manner as the above.

Also in the sixth embodiment, the construction is adopted, in which a driving potential is supplied from one signal line, for example, the signal line Dm to the two pixel electrodes A51 and B51 adjacent to each other so as to interpose one signal line, for example, the signal line Dm. Accordingly, compared to the conventional liquid crystal display apparatus in which the pixel and the signal line correspond to each other with a one-to-one correspondence relation, the number of the signal lines, that is, the number of the data drivers, can be halved.

In addition, the storage capacitor Cs is provided between the pixel electrode and the scanning line at the front stage of that pixel electrode also in the liquid crystal display apparatus of the sixth embodiment. Specifically, the storage capacitors Cs of the pixel electrodes A51 and B51 are provided between the respective pixel electrodes and the scanning line Gn at the front stage of these pixel electrodes, as shown in FIG.

Therefore, it is possible to provide a high quality image also in the liquid crystal display apparatus of the sixth embodiment.

Furthermore, according to the sixth embodiment, the number of the TFTs connected to the pixel electrodes A51 and B51 is two, and any of the gate electrodes of the first and third TFTs M51 and M53 connected to the signal line Dm is indirectly connected to the scanning line. Accordingly, the electrical characteristics of the pixel electrodes A51 and B51 can be made to match with each other, and a degradation of uniformity in a distribution of a display characteristic owing to a signal delay in the scanning line can be prevented.

As described above, according to the present invention, the number of the signal lines, that is, the number of the data drivers can be reduced by half or less without enlarging a size of the switching element. Furthermore, the image display device of the present invention using the scanning line as the storage capacitor can reduce the number of the data drivers by half. Therefore, the image display apparatus to which the present invention is applied, typically, the liquid crystal display apparatus, can cope with a high definition.

Although the preferred embodiments of the present invention have been described in detail, it should be understood that various changes, substitutions and alternations can be made therein without departing from spirit and scope of the inventions as defined by the appended claims.

What is claimed is:

1. An image display device, comprising:

a plurality of signal lines for supplying display signals;

a plurality of scanning lines for supplying scanning signals;

first and second pixel electrodes to which said display signals are supplied from specified one of said signal lines, wherein the first pixel electrode comprises two thin film transistors and the second pixel electrode comprises only one thin film transistor;

a first switching element disposed between the specified one of said signal lines and said first pixel electrode, said first switching element having a gate electrode for controlling supply of said display signals;

a second switching element disposed between said gate electrode of said first switching element and specified one of said scanning lines; and a third switching element connected to the specified one of said signal lines, the third switching element being for controlling supply of said display signals to said second pixel electrode.

2. The image display device according to claim 1, wherein a scanning line having nothing to do with drive of said first and second pixel electrodes is formed, a storage capacitor is formed between said scanning line and each of said first and second pixel electrodes.

3. The image display device according to claim 1, wherein a storage capacitor is formed between a specified scanning line and each of said first and second pixel electrodes, said specified scanning line being disposed at a front stage of said first and second pixel electrodes.

4. An image display device comprising:

a signal line for supplying a display signal;

first and second pixel electrodes having different electrical characteristics from one another, wherein said first and second pixel electrodes are arranged in a checked pattern so as to interpose said signal line therebetween, wherein the first pixel electrode comprises two thin film transistors and the second pixel electrode comprises only one thin film transistor;

a first switching element connected to said signal line, the first switching element being for controlling supply of said display signal to said first pixel electrode;

a second switching element connected to said first switching element;

a third switching element connected to said signal line, the third switching element being for controlling supply of said display signals to said second pixel electrode;

a first scanning line for supplying a scanning signal to said second and third switching elements; and a second scanning line for supplying a scanning signal to said first switching element.

5. The image display device according to claim 4, wherein said first scanning line is disposed at a rear stage of said first and second pixel electrodes, and said second scanning line is disposed at a rear stage of said first scanning line.

6. The image display device according to claim 4, wherein a third scanning line is provided at a front stage of said first and second pixel electrodes, and a storage capacitor is formed between said third scanning line and each of said first and second pixel electrodes.

7. The image display device according to claim 4, wherein said first switching element directly connects said first pixel electrode and said signal line.

8. The image display device according to claim 7, wherein said first scanning line is arranged at a front stage of said first and second pixel electrodes, and said second scanning line is arranged at a rear stage of said first and second pixel electrodes.

9. The image display device according to claim 4, further comprising a fourth switching element connected to said third switching element, the fourth switching element being supplied with a scanning signal from said second scanning line.

10. An image display device, in which a plurality of signal lines for supplying display signals and a plurality of scanning lines for supplying scanning signals are arrayed in a matrix fashion, comprising:

first and second pixel electrodes arranged between a n-th scanning line and a (n+1)-th scanning line (n: positive integer), the first and second pixel electrodes being supplied with a display signal from a specified signal line, wherein the first pixel electrode comprises two thin film transistors and the second pixel electrode comprises only one thin film transistor;

a first switching mechanism for permitting the display signal to pass therethrough when said (n+1)-th scanning line and a (n+m)-th scanning line (m: integer excluding 0 and 1) are simultaneously being selected; and a second switching mechanism for permitting the display signal to pass through to said second pixel electrode when said (n+1)-th scanning line is being selected wherein a storage capacitor is formed between each of said first and second pixel electrodes and said n-th scanning line.

11. The image display device according to claim 10 further comprising a third pixel electrode arranged between said n-th scanning line and said (n+1)-th scanning line (n: positive integer).

12. The image display device according to claim 11, wherein said first switching mechanism includes:

a first switching element connected to said specified signal line, the first switching element being driven by a scanning signal supplied from said (n+1)-th scanning line; and a second switching element connected to said first switching element, the second switching element being driven by a scanning signal supplied from said (n+m)-th scanning line.

13. An image display device comprising:

a plurality of signal lines for supplying display signals;

a plurality of scanning lines for supplying scanning signals;

a first pixel electrode arranged between a n-th scanning line (n: positive integer) and a (n+1)-th scanning line, the first pixel electrode being connected to a specified signal line, wherein said first pixel electrode comprises two thin film transistors;

a second pixel electrode connected to said specified signal line, wherein said second pixel electrode comprises only one thin film transistor; and a storage capacitor disposed between said first pixel electrode and said n-th scanning line, wherein said first pixel electrode is driven by a first scanning signal from the (n+1)-th scanning line and by a second scanning signal from a (n+m)-th scanning line (m: integer excluding 0 and 1), and said second pixel electrode is driven by a scanning signal from said (n+1)-th scanning line.

14. An image display apparatus, which arrays pixels in a matrix fashion composed of M rows and N columns (M and N: arbitrary positive integer) to form an image display section, said image display apparatus comprising:

a signal line driving circuit for supplying display signals;

a scanning line driving circuit for supplying scanning signals;

a plurality of signal lines extending from said signal line driving circuit;

a plurality of scanning lines extending from said scanning line driving circuit;

first and second pixel electrodes arranged between a n-th scanning line (n: positive integer equal to N or less) and a (n+1)-th scanning line and are adjacent to each other with a specified signal line interposed therebetween, wherein the first pixel electrode comprises two thin film transistors and the second pixel electrode comprises only one thin film transistor;

a first switching element driven by a scanning signal from a (n+2)-th scanning line, the first switching element being for controlling supply of a display signal from said specified signal line to said first pixel electrode;

a second switching element driven by a scanning signal from said (n+1)-th scanning line, the second switching element being for controlling turning ON/OFF of said first switching element; and a third switching element driven by a scanning signal from said (n+1)-th scanning line, the third switching element being for controlling supply of a display signal from said specified signal line to said second pixel electrode.

15. The image display apparatus according to claim 14, further comprising a fourth switching element driven by the scanning signal from said (n+2)-th scanning line, the fourth switching element being for controlling turning ON/OFF of said third switching element.

16. An image display apparatus, which arrays pixels in a matrix fashion composed of M rows and N columns (M and N: arbitrary positive integer) to form an image display section, said image display apparatus comprising;

a signal line driving circuit for supplying display signals;

a scanning line driving circuit for supplying scanning signals;

a plurality of signal lines extending from said signal line driving circuit;

a plurality of scanning lines extending from said scanning line driving circuit;

first and second pixel electrodes arranged between a n-th scanning line (n: positive integer equal to N or less) and a (n+1)-th scanning line and are adjacent to each other with a specified signal line interposed therebetween, wherein the first pixel electrode comprises two thin film transistors and the second pixel electrode comprises only one thin film transistor;

a storage capacitor disposed between said first and second pixel electrodes and said n-th scanning line;

a first switching element driven by a scanning signal from said (n+1)-th scanning line, the first switching element being for controlling supply of a display signal from said specified signal line to said first pixel electrode;

a second switching element driven by a scanning signal from a (n+2)-th scanning line, the second switching element being arranged between said first switching element and said first pixel electrode; and a third switching element driven by the scanning signal from said (n+1)-th scanning line, the third switching element being for controlling supply of a display signal from said specified signal line to said second pixel electrode.

17. The image display apparatus according to claim 16, wherein a storage capacitor is formed between each of said first arid second pixel electrodes and said n-th scanning line.

18. An image display apparatus, which arrays pixels in a matrix fashion composed of M rows and N columns (M and N: arbitrary positive integer) to form an image display section, said image display apparatus comprising:

a signal line driving circuit for supplying display signals;

a scanning line driving circuit for supplying scanning signals;

a plurality of signal lines extending from said signal line driving circuit;

a plurality of scanning lines extending from said scanning line driving circuit;

first, second and third pixel electrodes arranged between a n-th scanning line (n: positive integer equal to N or less) and a (n+1)-th scanning line, the first, second and third pixel electrodes being supplied with a display signal from a specified signal line;

a first switching element driven by a scanning signal from a (n+3)-th scanning line, the first switching element being for controlling supply of the display signal from said specified signal line to said first pixel electrode;

a second switching element driven by a scanning signal from said (n+1)-th scanning line, the second switching element being for controlling turning ON/OFF of said first switching element;

a third switching element driven by the scanning signal from said (n+1)-th scanning line, the third switching element being for controlling supply of the display signal from said specified signal line to said second pixel electrode;

a fourth switching element driven by a scanning signal from a (n+2)-th scanning line, the fourth switching element being for controlling supply of the display signal from said specified signal line to said third pixel electrode; and a fifth switching element driven by the scanning signal from said (n+1)-th scanning line, the fifth switching element being for controlling turning ON/OFF of said fourth switching element.

19. The image display apparatus according to claim 18, wherein said signal line driving circuit sequentially supplies said specified signal line with a display signal having a potential to be given to said first pixel electrode, a display signal having a potential to be given to said second pixel electrode, and a display signal having a potential to be given to said third pixel electrode.

20. An image display apparatus, which arrays pixels in a matrix fashion composed of M rows and N columns (M and N: arbitrary positive integer) to form an image display section, said image display apparatus comprising:

a signal line driving circuit for supplying display signals;

a scanning line driving circuit for supplying scanning signals;

a plurality of signal lines extending from said signal line driving circuit;

a plurality of scanning lines extending from said scanning line driving circuit; and first, second and third pixel electrodes connected to a same signal line and arrayed on the same display line in parallel with said scanning line, the first, second and third pixel electrodes being supplied with display signals from a specified signal line, wherein the first pixel electrode comprises two thin film transistors and the second pixel electrode comprises only one thin film transistor;

wherein said first, second and third pixel electrodes are driven by scanning signals from different scanning lines.

21. An image display apparatus, which arrays pixels in a matrix fashion composed of M rows and N columns (M and N: arbitrary positive integer) to form an image display section, said image display apparatus comprising:

a signal line driving circuit for supplying display signals;

a scanning line driving circuit for supplying scanning signals;

a plurality of signal lines extending from said signal line driving circuit;

a plurality of scanning lines extending from said scanning line driving circuit;

first and second pixel electrodes arranged between a n-th scanning line (n: positive integer equal to N or less) and a (n+1)-th scanning line and are adjacent to each other with a specified signal line interposed therebetween, wherein the first pixel electrode comprises two thin film transistors and the second pixel electrode comprises only one thin film transistor;

a first switching element driven by a scanning signal from said (n+1)-th scanning line, the first switching element being for controlling supply of a display signal from said specified signal line to said first pixel electrode;

a second switching element driven by a scanning signal from said n-th scanning line, the second switching element being for controlling turning ON/OFF of said first switching element; and a third switching element driven by the scanning signal from said n-th scanning line, the third switching element being for controlling supply of the display signal from said specified signal line to said second pixel electrode.

22. An image display apparatus, which arrays pixels in a matrix fashion composed of M rows and N columns (M and N: arbitrary positive integer) to form an image display section, said image display apparatus comprising:

a signal line driving circuit for supplying display signals;

a scanning line driving circuit for supplying scanning signals;

a plurality of signal lines extending from said signal line driving circuit;

a plurality of scanning lines extending from said scanning line driving circuit;

first and second pixel electrodes arranged between a n-th scanning line (n: positive integer equal to N or less) and a (n+1)-th scanning line so as to be adjacent to each other with a specified signal line interposed therebetween;

a first switching element driven by a scanning signal from said (n+2)-th scanning line, the first switching element being for controlling supply of a display signal from said specified signal line to said first pixel electrode;

a second switching element driven by a scanning signal from said (n+1)-th scanning line, the second switching element being for controlling turning ON/OFF of said first switching element;

a third switching element driven by the scanning signal from said (n+1)-th scanning line, the third switching element being for controlling supply of the display signal from said specified signal line to said second pixel electrode;

a fourth switching element driven by the scanning signal from said (n+2)-th scanning line, the fourth switching element being for controlling turning ON/OFF of said first switching element; and a charge capacitor connected to said third switching element, the charge capacitor being capable of holding charges given to said third switching element.

23. An image display apparatus, comprising:

a plurality of signal lines for supplying display signals;

a plurality of scanning lines for supplying scanning signals;

first and second pixel electrodes arranged between a n-th scanning line (n: positive integer) and a (n+1)-th scanning line and are adjacent to each other with a specified signal line interposed therebetween, wherein the first pixel electrode comprises two thin film transistors and the second pixel electrode comprises only one thin film transistor;

a storage capacitor arranged between said first and second pixel electrodes and one of said scanning lines adjacent to said pixel electrode;

a first switching element connected to said pixel electrode; and a second switching element for controlling turning ON/OFF of said first switching element.

24. An image display apparatus, comprising:

a plurality of signal lines for supplying display signals;

a plurality of scanning lines for supplying scanning signals;

first and second pixel electrodes arranged between a n-th scanning line (n: positive integer) and a (n+1)-th scanning line and are adjacent to each other with a specified signal line interposed therebetween, wherein the first pixel electrode comprises two thin film transistors and the second pixel electrode comprises only one thin film transistor; and a storage capacitor arranged between first and second pixel electrodes and one of said scanning lines adjacent to said first and second pixel electrodes, wherein said first and second pixel electrodes is driven by scanning signals supplied from at least two scanning lines excluding the one of said scanning lines.

25. A method of driving an image display device which comprises: a plurality of signal lines for supplying display signals; a plurality of scanning lines for supplying scanning signals; a first pixel electrode arranged between a n-th scanning line and a (n+1)-th scanning line (n: arbitrary positive integer), the first pixel electrode being connected to a specified signal line; a storage capacitor disposed between said first pixel electrode and said n-th scanning line; and a second pixel electrode connected to said specified signal line, said method comprising:

supplying a first display signal to said specified signal line, the first display signal having a first potential to be given to said first pixel electrode, for a period from the time when potentials of said (n+1)-th scanning line and a (n+m)-th scanning line (in: integer excluding 0 and 1) become equal to a selection potential to the time when the potential of one of said (n+1)-th scanning line and said (n+m)-th scanning line becomes equal to a non-selection potential, thus giving said first potential to said first and second pixel electrodes, wherein the first pixel electrode comprises two thin film transistors and the second pixel electrode comprises only one thin film transistor; and supplying a second display signal to said specified signal line, the second display signal having a second potential to be given to said second pixel electrode, after the potential of one of said (n+1)-th scanning line and said (n+m)-th scanning line becomes equal to the non-selection potential, thus giving said second potential to said second pixel electrode.

* * * * *